US005230995A

United States Patent [19]

Asami

[11] Patent Number: 5,230,995

[45] Date of Patent: Jul. 27, 1993

[54] METHOD OF MANUFACTURING SILVER HALIDE EMULSION AND A COLOR PHOTOGRAPHIC MATERIAL HAVING THE EMULSION MANUFACTURED BY THE METHOD

[75] Inventor: Masahiro Asami, Kanagawa, Japan

[73] Assignee: Fuji Photo Film Co., Ltd., Kanagawa, Japan

[21] Appl. No.: 691,277

[22] Filed: Apr. 25, 1991

[30] Foreign Application Priority Data

Apr. 26, 1990 [JP] Japan ..... 2-111180

[51] Int. Cl.[5] ..... G03C 1/12

[52] U.S. Cl. ..... 430/567; 430/569; 430/572; 430/574; 430/613; 430/615

[58] Field of Search ..... 430/567, 550, 569, 572, 430/574, 611, 613, 615

[56] References Cited

U.S. PATENT DOCUMENTS

| | | | |
|---|---|---|---|
| 3,881,936 | 5/1975 | Hayakawa et al. | 430/574 |
| 4,582,786 | 4/1986 | Ikeda et al. | 430/577 |
| 4,791,053 | 12/1988 | Ogawa | 430/581 |
| 4,902,609 | 2/1990 | Hahm | 430/504 |
| 5,011,768 | 4/1991 | Ogawa | 430/569 |
| 5,015,563 | 5/1991 | Ohya et al. | 430/546 |
| 5,047,311 | 9/1991 | Endo et al. | 430/204 |
| 5,084,374 | 1/1992 | Waki et al. | 430/504 |

FOREIGN PATENT DOCUMENTS

| | | | |
|---|---|---|---|
| 62-276539 | 12/1987 | Japan | 430/572 |

*Primary Examiner*—Charles L. Bowers, Jr.
*Assistant Examiner*—John A. McPherson
*Attorney, Agent, or Firm*—Sughrue, Mion, Zinn, Macpeak & Seas

[57] ABSTRACT

In a method of manufacturing a silver halide emulsion which comprises a silver chlorobromide having a silver chloride content of 90 mol% or more or silver chloride and said silver halide containing substantially no silver iodide, the improvement which comprises the steps of, (i) adding to a reactor a compound capable of spectrally sensitizing the silver halide emulsion in a wavelength range between 590 nm and 720 nm, and (ii) then adding to the reactor a compound capable of spectrally sensitizing the silver halide emulsion in a wavelength range between 390 nm and 590 nm, prior to the completion of chemical sensitization of the silver halide emulsion, and color photographic material having the emulsion manufactured by the method.

22 Claims, No Drawings

METHOD OF MANUFACTURING SILVER HALIDE EMULSION AND A COLOR PHOTOGRAPHIC MATERIAL HAVING THE EMULSION MANUFACTURED BY THE METHOD

FIELD OF THE INVENTION

The present invention relates to a method of preparing a silver halide emulsion as well as to a color photographic material having the emulsion prepared by that method. More precisely, it relates to a method of preparing a silver halide emulsion which may be subjected to rapid processing, which has excellent tone reproducibility and color reproducibility, and which has a stable photographic capacity. The present invention also relates to a color photographic material having the emulsion prepared by the present method.

BACKGROUND OF THE INVENTION

Color photographic materials which are now generally distributed in the market are composed of silver halides as light-sensitive elements and color couplers as color-forming elements. When such a color photographic material is imagewise exposed and then processed with a developer containing an aromatic primary amine compound as a developing agent, only the exposed silver halide grains in the material are reduced to a metal silver by the developing agent. The oxidation product of the developing agent to be formed by the reduction is coupled with the couplers in the material by a coupling reaction to form dyes. As a result, a color image which corresponds to the exposed pattern is formed in the material. The metal silver formed by development and the non-developed silver halides are removed by the successive bleaching and fixation steps to yield a stable color image. When yellow-coloring, magenta-coloring and cyan-coloring couplers are incorporated into the photographic material, reproduction of a natural color image is possible by the subtraction process of the three primary colors.

The color image-forming system based on the principle is the most popular one in the current technical field, and various studies on the system are being made for the purpose of improving it.

The most important approach to improving the color image-forming system is to shorten the access time. For instance, in the market of color prints, there is an increasing demand for finishing a large number of color prints in a short period of time. Because of that demand, rapid processing of photographic materials in a shortened period of time is an important goal. In order to achieve the goal, therefore, many reports have been made relating to silver halide emulsions having a high development rate, couplers having a high coupling activity and processing agents capable of rapid development. As an example, International Patent Application Laid-Open No. WO87-04534 illustrates a method of processing a color photographic material having a high silver chloride emulsion with a color developer containing substantially no sulfite ion or benzyl alcohol.

However, when a printing color photographic material having a silver halide emulsion with an elevated silver chloride content is used to form a color print, it has been found to yield poor results at the point of color reproduction. Precisely, when a color print is formed from a negative film which is exposed to take a picture from an object having a high chroma (for instance, red flowers or wears), using a photographic material of that type, satisfactory reproduction of the shadow-tone of the object is impossible. Only an image which lacks a three-dimensional and solid sense is obtained.

As a result of the inventors'analysis of this problem, it has been determined that the problem is caused by the difference in intrinsic sensitivity distribution between the silver chlorobromide emulsion which has heretofore been used in conventional printing color photographic materials and the high silver chloride emulsion which has been developed for rapid-processable color photographic materials.

In general, a silver halide emulsion constituting the light-sensitive element of a color photographic material has (i) a so-called intrinsic sensitivity, which is the sensitivity corresponding to the light-absorption of the silver halide itself, and (ii) a so-called color-sensitivity of blue-sensitivity, green-sensitivity or red-sensitivity, which is imparted to the emulsion for reproduction of a natural color. The longest wavelength of the distribution of the intrinsic sensitivity, depends upon the halogen formulation of the emulsion grain. For instance, a pure silver chloride emulsion has a wavelength of about 400 nm, a pure silver bromide emulsion has a wavelength of about 500 nm, and a mixed silver halide emulsion of them has a value which is proportional to the halogen formulation. Accordingly, a printing color photographic material having a silver chlorobromide emulsion has a sensitivity, as the total light-sensitive layer, to a blue light having a high strength, while another material having a high silver chloride emulsion does not have a sensitivity to blue light. Consequently, employment of such a high silver chloride emulsion is extremely advantageous for reproduction of high-purity yellow and green. On the contrary, however, expression of shadow of an object having a high chroma is impossible with a high silver chloride emulsion. As a result, a high silver chloride emulsion yields only a flat image, but not solid or cubic one. When a silver chlorobromide emulsion is used, expression of the shadow of an object having a high chroma is possible, but the yellow and green colors of the reproduced image are not clear. (For instance, a cyan color gradation is expressed in a dark red image.)

Some techniques for overcoming this drawback of high silver chloride emulsions have been proposed. For instance, U.S. Pat. No. 4,806,460 illustrates a photographic material which may yield an additional cyan gradation when the image density of yellow or magenta exceeds a predetermined density. European Patent 304,297A2 illustrates a technique of adding a green-sensitizing dye to a red-sensitive emulsion layer containing a cyan color-forming coupler.

However, it has been found that the photographic materials prepared by these proposed techniques have various drawbacks. First, in order to attain faithful tone reproduction without making a pure color turbid, the gradation to the second color sensitization (blue-sensitization or green-sensitization) to be applied to the silver halide emulsion in the cyan-coloring layer must be controlled exactly. However, the gradation in the blue-sensitive area or the green-sensitive area often becomes soft because of the difference in the sensitizing characteristic between the red-sensitizing dye and the blue-sensitizing or green-sensitizing dye. Second, the sensitivity and gradation of the red-sensitive area and those of the blue-sensitive or green-sensitive area often vary and fluctuate during the course of preparation of photographic materials or during storage of the coating compositions before coating. This variation or fluctuation also occurs during storage of the prepared photographic materials. In other words, the stability of the photographic property of the photographic materials prepared by these prior art techniques is poor.

Thus, improvement of the stability of the tone reproducibility in photographic material having a rapid processable high silver chloride emulsion is an extremely important matter for the purpose of satisfying both goals of a high producibility of the material and an excellent image quality of the image formed on the material.

SUMMARY OF THE INVENTION

One object of the present invention is to provide a method of preparing a silver halide emulsion, which may be readily processed by rapid processing and has excellent tone reproducibility and color. reproducibility and which has a stable photographic capacity. Another object of the present invention is to provide a color photographic material having the emulsion prepared by that method.

These and other objects of the present invention have been attained by a method of manufacturing a silver halide emulsion which comprises a silver chlorobromide having a silver chloride content of 90 mol% or more or silver chloride and the above mentioned silver halide containing substantially no silver iodide which is spectrally sensitized to have a peak of spectral sensitivity distribution both in the wavelength range between 590 nm and 720 nm and in the wavelength range between 390 nm and 590 nm, which comprises the steps of, (i) adding to a reactor a compound capable of spectrally sensitizing the silver halide emulsion in a wavelength range between 590 nm and 720 nm and then (ii) adding to the reactor a compound capable of spectrally sensitizing the silver halide emulsion in a wavelength range between 390 nm and 590 nm, prior to the completion of chemical sensitization of the silver halide emulsion.

As further object of the present invention is a color photographic material comprising, a support having thereon, at least one light-sensitive emulsion layer containing a yellow coupler capable of forming a yellow dye by coupling with the oxidation product of an aromatic primary amine developing agent, at least one light-sensitive emulsion layer containing a magenta coupler capable of forming a magenta dye by coupling with the oxidation product of an aromatic primary amine developing agents, and at least one light-sensitive emulsion layer containing a cyan coupler capable of forming a cyan dye by coupling with the oxidation product of an aromatic primary amine developing agent, wherein the emulsion layer containing the cyan coupler capable of forming a cyan dye comprises the cyan coupler and a silver halide emulsion which comprises a silver chlorobromide having a silver chloride content of 90 mol% or more or silver chloride and the above mentioned silver halide containing substantially no silver iodide which is spectrally sensitized to have a peak of spectral sensitivity distribution both in the wavelength range between 590 nm and 720 nm and in the wavelength range between 390 nm and 590 nm, and the above mentioned silver halide emulsion being manufactured by the steps of, (i) adding to a reactor a compound capable of spectrally sensitizing the silver halide emulsion in a wavelength range between 590 nm and 720 nm, and then (ii) adding to the reactor a compound capable of spectrally sensitizing the silver halide emulsion in a wavelength range between 390 nm and 590 nm, prior to the completion of chemical sensitization of the silver halide emulsion.

DETAILED DESCRIPTION OF THE INVENTION

In one preferred embodiment of the method of the present invention, the step (i) mentioned above is carried out (a) before the reaction of a silver nitrate with an alkali halide, (b) during the reaction of a silver nitrate with an alkali halide, (c) during physical ripening after the reaction of a silver nitrate with an alkali halide, (d) during a desalting (e) prior to initiating the chemical sensitization, (5) during the chemical sensitization or (f) prior to initiating a desalting. In the other preferred embodiment of the method of the present invention, the steps (i) and (ii) are carried out prior to initiating the desalting. In addition, the step (ii) is preferably carried out prior to initiating the desalting but after the formation of the silver halide grain.

It is necessary that the silver halide emulsion to be prepared by the method of the present invention contains substantially no silver iodide and comprises silver chlorobromide having a silver chloride content of 90 mol% or more or comprises silver chloride.

The wording "contains substantially no silver iodide" as referred to herein means that the silver iodide content in the emulsion is 0.5 mol% or less, preferably 0.1 mol% or less based on the total silver halide content. More preferably, the emulsion contains no silver iodide. The silver chloride content in the emulsion must be 90 mol% or more, and it is preferably 95 mol% or more, especially preferably 98 mol% or more based on the total silver halide content. An emulsion comprising pure silver chloride, that is one which may contain only a slight amount of polyvalent metal impurity ions, is also preferred.

Where the silver halide emulsion of the present invention contains silver bromide, the grains in the emulsion may have various forms. Specifically, the grain may be derived from a so-called solid solution in which silver bromide is uniformly distributed throughout the grain, or a silver bromide-containing phase may be unevenly located in the grain. In the latter case, the silver bromide-containing phase may have various forms. For instance, a plurality of phases, each having a different silver bromide content, may form a so-called laminate structure comprising core and shell, or a silver bromide-rich phase may separately form a localized phase in the inside (core) of the grain or on a part of the surface (shell) thereof.

The silver halide emulsion of the present invention may contain one or more polyvalent metal impurity ions for the purpose of obtaining a high sensitivity and a high contrast. Such ions may be introduced into the emulsion during the formation of the silver halide grains. Examples of such impurity ions include salts or complexes of ions of Group VIII transition metals such as iron, cobalt, nickel, ruthenium, rhodium, palladium, osmium, iridium or platinum, as well as salts of ions of divalent metals such as copper, zinc, cadmium or lead.

The silver halide grains to be in the silver halide emulsion of the present invention are desired to have a mean grain size of from 0.1 micron to 2 microns. (The mean grain size is the number average mean value of grain sizes of the grains, and the grain size is the diameter of a circle having the same area as the projected area of each grain.)

The grain size distribution in the emulsion is preferably 20% or less, more desirably 15% or less, as the fluctuation coefficient thereof (value obtained by dividing the standard deviation of the grain size distribution by the mean grain size). That is, the emulsion is preferably monodispersed. In particular, in order to obtain a broad latitude, two or more monodispersed emulsions may be blended to form a single emulsion layer, or they may be separately coated on a support to form a plurality of layers thereon.

The silver halide grains of the photographic emulsion of the present invention may have a regular crystalline form such as cubic, octahedral or tetradecahedral grains, or an irregular crystalline form such as spherical or tabular grains, or a composite crystalline form composed of the above-mentioned regular and irregular crystalline forms. The emulsion of the present invention may comprise a mixture of various grains of different crystalline forms. Above all, the emulsion of the invention preferably contains regular crystalline grains in a proportion of 50% or more, preferably 70% or more, especially preferably 90% or more, based on the total silver halide grains.

The silver chlorobromide or silver chloride emulsion of the present invention can be prepared in accordance with the methods described in P. Glafkides, *Chimie et Phisique Photographique* (published by Paul Montel, 1967), G.F Duffin, *Photographic Emulsion Chemistry* (published by Focal Press, 1966), and V. L. Zelikman, *Making and Coating Photographic Emulsion* (published by Focal Press, 1964). For example, the silver halide emulsion may be prepared by an acid method, a neutralization method or an ammonia method. As a method of reacting a soluble silver salt and soluble halide(s) to form a silver halide emulsion, a single jet method, or a double jet method, or a combination of the two, may be employed. A reverse mixing method capable of forming silver halide grains in the presence of an excessive amount of silver ions can also be employed. In one system of the double jet method, a controlled double jet method of keeping a constant silver ion concentration in a liquid phase for forming silver halide grains may also be employed. According to that method, a monodispersed silver halide emulsion containing silver halide grains having a regular crystal form and having a narrow grain size distribution can be obtained.

The silver halide emulsion of the present invention is chemically sensitized and spectrally sensitized.

Chemical sensitization of the silver halide emulsion of the present invention may be effected by sulfur sensitization, selenium sensitization, reduction sensitization and/or noble metal sensitization.

Examples of the compounds appropriate for sulfur sensitization include thiosulfates, rhodanines, thioureas, thioamides (for example, those described in U.S. Pat. Nos. 2,410,689, 3,501,313, 2,278,947, 1,574,944, 2,728,868, 3,656,955, 4,001,025 and 4,116,697, and JP-A-55-45016), thioesters (for example, those described in JP-B-43-13485 and 55-42374, and British Patent 1,190,678), and polysulfur compounds (for example, those described in U.S. Pat. Nos. 3,647,469, 3,656,955, 3,689,273, JP-A-53-81230, and JP-B-49-20533 and 59-45134). (The terms "JP-A" and "JP-B" as used herein means an "unexamined published Japanese patent application" and an "examined Japanese patent publication", respectively.)

Examples of compounds appropriate for selenium sensitization include selenium compounds as described in JP-A-60-150046.

Examples of compounds appropriate for reduction sensitization include inorganic reducing agents such as $SnCl_2$ and $NaBH_4$, as well as amines, hydrazines, formamidinesulfinic acids, silane compounds (for example, those described in U.S. Pat. Nos. 2,518,698, 2,743,182, 3,369,904, 2,666,700, 2,419,973, 2,419,974, 2,419,975, 2,740,713, 2,521,926, 2,487,850, 2,983,609, 2,983,610, 2,694,637, 3,930,867 and 3,904,415, British Patent 1,390,540, and JP-A-50-127622 and 57-163232), and aldehydes (for example, those described in U.S. Pat. No. 2,604,397).

Examples of compounds appropriate for noble metal sensitization include complex compounds of transition elements of Group VIII of the Periodic Table, such as gold, platinum, iridium or palladium (for example, those described in U.S. Pat. Nos. 2,399,083, 2,448,060, 3,503,749, 2,597,856, 2,597,915, 2,624,674 and 2,642,361 and British Patent 618,061).

Spectral sensitization of the silver halide emulsion of the present invention for the purpose of making the emulsion sensitive to light falling within a desired wavelength range may be conducted by adding to the emulsion a spectral sensitizing dye capable of absorbing light falling within the wavelength range corresponding to the intended spectral sensitivity.

Examples of the spectral sensitizing dyes appropriate for that purpose include the compounds described, for example, in F. H. Harmer, *Heterocyclic Compounds—Cyanine Dyes and Related Compounds* (published by John Wiley & Sons, New, York, London, 1964). Spectral sensitizing dyes appropriate for the present invention include cyanine dyes, merocyanine dyes, and complex merocyanine dyes. Additionally, complex cyanine dyes, holopolar cyanine dyes, hemicyanine dyes, styryl dyes and hemioxonole dyes may also be used. Preferred among these dyes are simple cyanine dyes, carbocyanine dyes and dicarbocyanine dyes. Such cyanine dyes are represented by the following general formula (I):

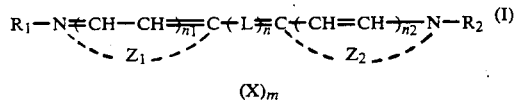

(I)

where represents a methine group or a substituted methine group;

R1 and R2 each represents an alkyl group or a substituted alkyl group;

Z1 and Z2 each represents an atomic group for forming a nitrogen-containing 5-membered or 6-membered heterocyclic nucleus;

X represents an anion;

n represents a number of 1, 3 or 5;

n1 and n2 each represents 0 or 1, and when n=5, both n1 and n2 are 0, and when n=3, either n1 or n2 is 0;

m represents 0 or 1, but when the formula forms an internal salt, m is 0; and when n=5, the plurality of L groups may be bonded to each other to form a substituted or unsubstituted 5-membered or 6-membered ring.

Examples of the substituents to the substituted methine group represented by L include lower alkyl groups (e.g., methyl, ethyl) and aralkyl groups (e.g., benzyl, phenethyl).

The alkyl groups represented by R1 or R2 may be linear, branched or cyclic. The number of carbon atoms constituting the alkyl group is not specifically defined but is preferably from 1 to 8, more preferably from 2 to 7. Examples of the substituents to the substituted alkyl group include a sulfonic acid group, a carboxylic acid group, a hydroxyl group, an alkoxy group, an acyloxy group, and an aryl group e.g, phenyl, substituted phenyl). One or more of these substituents may be bonded to the alkyl group singly or in combination of two or more. Among them, the sulfonic acid group and the carboxylic acid group may form salts with alkali metal ions or quaternary ions of organic amines. The combination of two or more substituents in the substituted alkyl group includes those examples in which the different substituents are independently bonded to the alkyl moiety and those examples in which they are combined with each other and the resulting combination is bonded to the alkyl moiety. Examples of the latter include a sulfoalkoxyalkyl group, a sulfoalkoxyalkoxyalkyl group, a carboxyalkoxyalkyl group and a sulfophenylalkyl group.

Examples of R1 and R2 include a methyl group, an ethyl group, an n-propyl group, an n-butyl group, an n-pentyl group, a 2-hydroxyethyl group, a 4-hydroxybutyl group, a 2-acetoxyethyl group, a 3-acetoxypropyl group, a 2-methoxyethyl group, a 4-methoxybutyl group, a 2-carboxyethyl group, a 3-carboxypropyl group, a 2-(2-carboxyethoxy)ethyl group, a 2-sulfoehtyl group, a 3-sulfopropyl group, a 3-sulfobutyl group, a 4-sulfobutyl group, a 2-hydroxy-3-sulfopropyl group, a 2-(3-sulfopropoxy)ethyl group, a 2-acetoxy-3-sulfopropyl group, a 3-methoxy-2-(3-sulfopropoxy)propyl group, a 2-[2-(3-sulfopropoxy)ethoxy]-ethyl group, and a 2-hydroxy-3-(3'-sulfopropoxy)propyl group.

Examples of the nitrogen-containing heterocyclic ring formed by Z1 or Z2 include an oxazole nucleus, a thiazole nucleus, a selenazole nucleus, an imidazole nucleus, a pyridine nucleus, an oxazoline nucleus, a thiazoline nucleus, a selenazoline nucleus, an imidazoline nucleus, as well as condensed nuclei composed of such nuclei and a benzene ring, a naphthalene ring or another saturated or unsaturated carbon ring. These nitrogen-containing heterocyclic rings may further be substituted by substituent(s) (for example, an alkyl group, a trifluoromethyl group, an alkoxycarbonyl group, a cyano group, a carboxylic acid group, a carbamoyl group, an alkoxy group, an aryl group, an acyl group, a hydroxyl group, or a halogen atom).

Examples of the anion X include Cl−, Br−, I−, $SO_4$−, $NO_3$− and $ClO_4$−.

Such merocyanine dyes or complex merocyanine dyes may be combined with a 5-membered or 6-membered nucleus, such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus, as a ketomethylene structure-containing nucleus.

In addition to the above-mentioned spectral sensitizing dyes, other dyes having a pyrroline nucleus, an oxazoline nucleus, a thiazoline nucleus, a pyrrole nucleus, a thiazole nucleus, an oxazole nucleus, a selenazole nucleus, an imidazole nucleus, a tetrazole nucleus, a pyridine nucleus, or a condensed nucleus composed of that nucleus and an alicyclic hydrocarbon ring or a condensed nucleus composed of that nucleus and an aromatic hydrocarbon ring, may also be used in the present invention.

Appropriate spectral sensitizing dyes include, for example, those described in German Patent 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent 1,242,588, and JP-B-44-14030 and 52-24844.

Among the above-mentioned dyes, those having a benzothiazole nucleus or benzoxazole nucleus are preferred. Especially preferred are simple cyanine dyes having a benzothiazole nucleus, carbocyanine dyes having a benzoxazole nucleus, and dicarbocyanine dyes having a benzothiazole nucleus.

The silver halide emulsion treated by the method of the present invention is spectrally sensitized in such a way that it has a peak of spectral sensitivity distribution in the wavelength range between 590 nm and 720 nm (hereinafter referred to as "red light range") and in the wavelength range between 390 nm and 590 nm (the wavelength range between 390 nm and 510 nm is hereinafter referred to as "blue light range"; and that between 510 nm and 590 nm, as "green light range"). For the purpose of spectrally sensitizing the emulsion in the above-mentioned way, the above-mentioned sensitizing dyes having an absorption in a red light range when they are added to the emulsion, as well as the above-mentioned sensitizing dyes having an absorption in a blue light range or green light range when they are added to the emulsion, may be employed. In general, for the purpose of spectrally sensitizing a silver halide emulsion, it is necessary that a sensitizing dye is adsorbed to the surfaces of the silver halide grains in the emulsion. Specifically, in carrying out the method of the present invention, it is necessary that the sensitizing dye which may spectrally sensitize the emulsion in a red light range is first added to the emulsion prior to the addition of the sensitizing dye which may spectrally sensitizing the emulsion in a blue light range or green light range.

The time at which the red-sensitizing dye is added to the silver halide emulsion is between prior to the start of the formation of the emulsion grains and the completion of chemical sensitization of those grains. Precisely, examples of adding the dye include a method in which a spectra sensitizing dye is added to the reactor prior to the start of formation of the emulsion grains; a method of adding a spectral sensitizing dye to silver halide grains during formation of precipitates of grains, as described in U.S. Pat. No. 2,735,766; a method of adding a spectral sensitizing dye to the reaction system of forming silver halide grains, which comprises an aqueous silver salt solution and an aqueous halide solution, so that the dye is adsorbed to the grains formed, as described in JP-A-55-26589; a method of adding a spectral sensitizing dye to the silver halide grains after substantial completion of the step of forming the grains but before or during the step of de-salting the grains so that the dye is adsorbed to the grains; and a method of adding a spectral sensitizing dye to the silver halide grains before chemical sensitization of the grains or during but before completion of chemical sensitization thereof so that the dye is adsorbed to the grains.

In carrying out the method of the present invention, it is necessary that the addition of the red-sensitizing dye to the emulsion precede the addition of the blue- or green-sensitizing dye thereto. It is preferred that the former addition is effected before the start of chemical sensitization of the emulsion grains. The time for adding the blue- or green-sensitizing dye to the emulsion may be between the formation of the emulsion grains and the completion of chemical sensitization thereof, but it must be later than the time for adding the above-mentioned red-sensitizing dye to the emulsion. If not, the gradation corresponding to the blue light range or green light range would be disadvantageously softened, or the sensitivity or gradation in the red light range, the blue light range or the green light range would vary or fluctuate during the formation of photographic materials when the coating compositions are stored before coating, or during storage of the formed photographic materials.

The spectral sensitizing dyes to be added to the emulsion in accordance with the present invention may be directly added thereto while they are in the form of a crystal or powder. However, it is preferred that they are dissolved or dispersed and that the resulting solution or dispersion is added to the emulsion. For instance, to dissolve such spectral sensitizing dyes, a water-soluble solvent (such as an alcohol having from 1 to 3 carbon atoms, acetone, pyridine or methyl cellosolve or a mixed solvent thereof) may be used. Additionally, the dyes may be micelle-dispersed by the use of a surfactant or may be dispersed by any other means, and the resulting dispersion may be added to the emulsion.

The amount of the spectral sensitizing dyes to be used in the present invention varies within a broad range on a case by case basis. Generally, it may be from $1\times10^{-6}$ mol to $1\times10^{-2}$ mole, preferably from $1\times10^{-5}$ mol to $1\times10^{-3}$ mol, per mol of silver halide, respectively. Examples of the cyanine dyes of formula (I) are mentioned below.

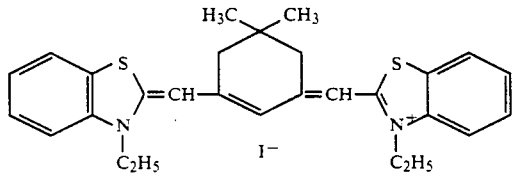

(I-1)

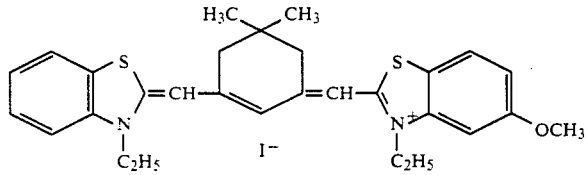

(I-2)

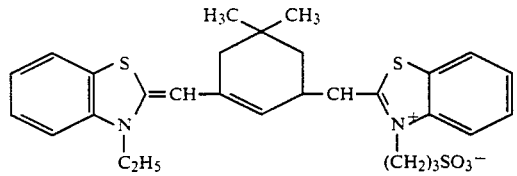

(I-3)

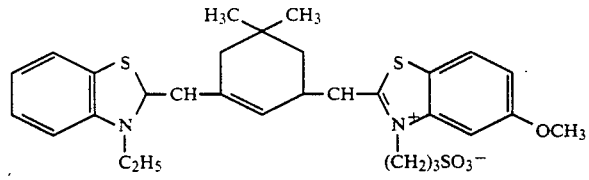

(I-4)

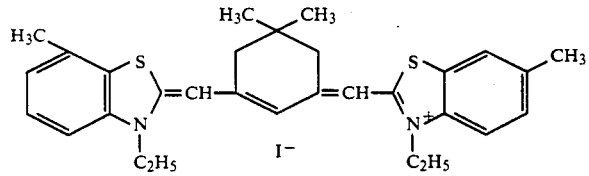

(I-5)

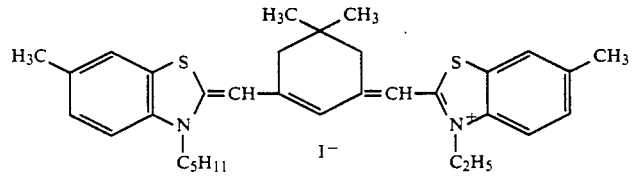

(I-6)

-continued
(I-7)
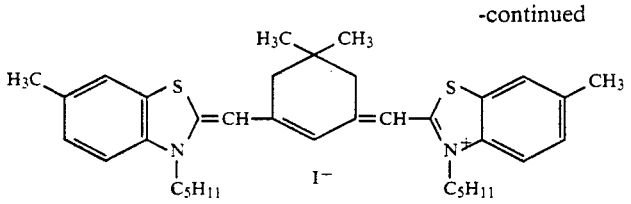
(I-8)
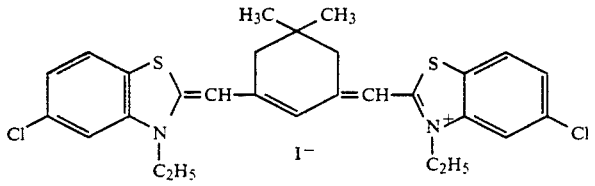
(I-9)
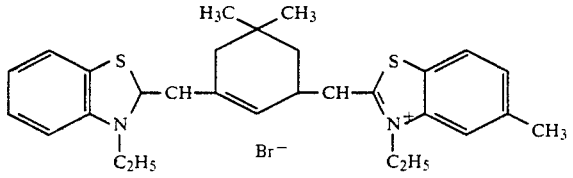
(I-10)
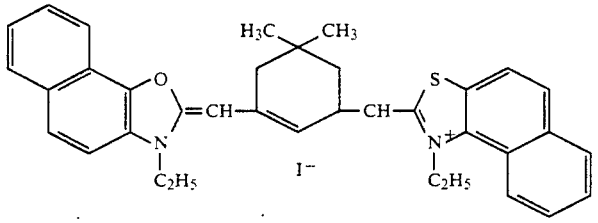
(I-11)
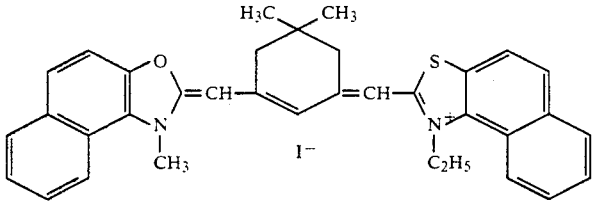
(I-12)
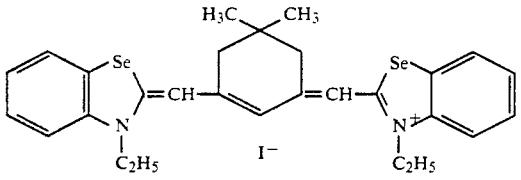
(I-13)
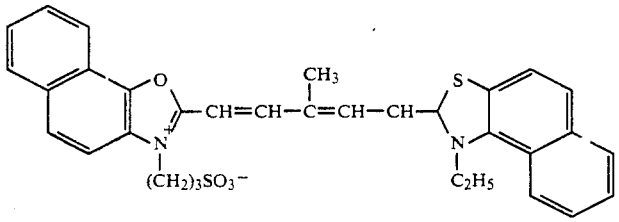
(I-14)
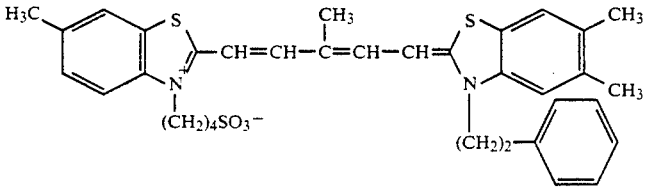

-continued
(I-15)
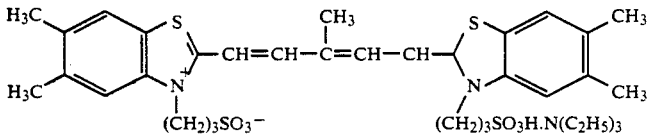
(I-16)
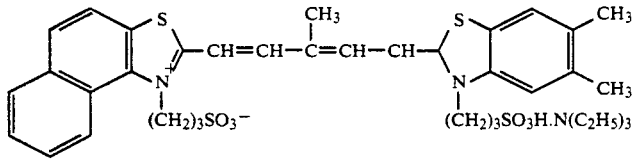
(I-17)
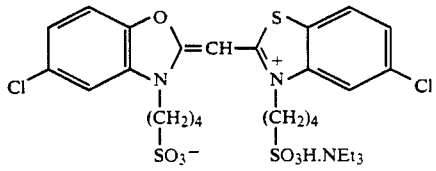
(I-18)
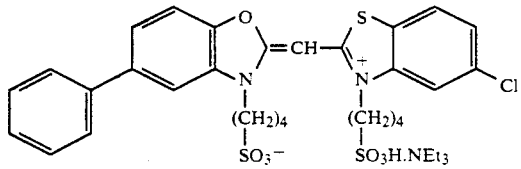
(I-19)
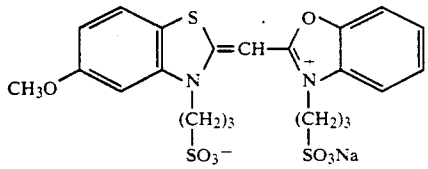
(I-20)
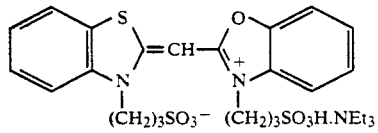
(I-21)
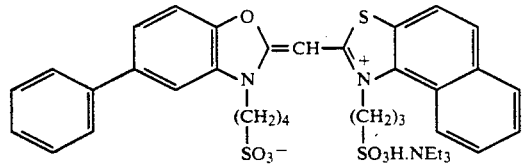
(I-22)
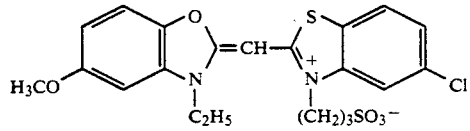
(I-23)
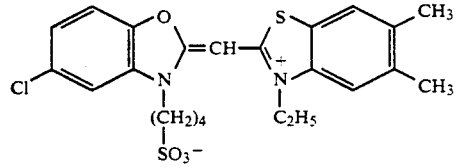

-continued
(I-24)
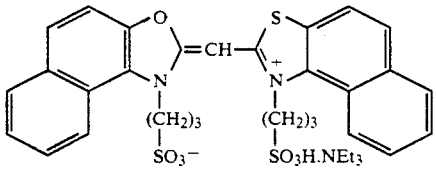
(I-25)
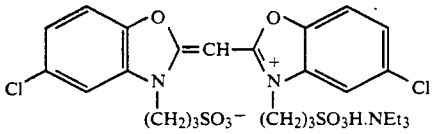
(I-26)
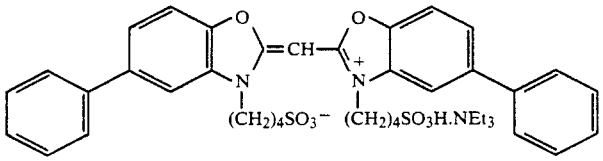
(I-27)
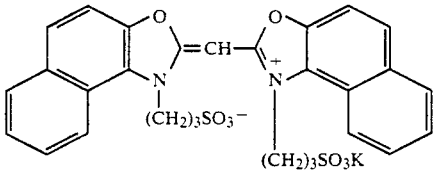
(I-28)
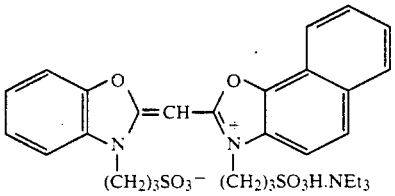
(I-29)
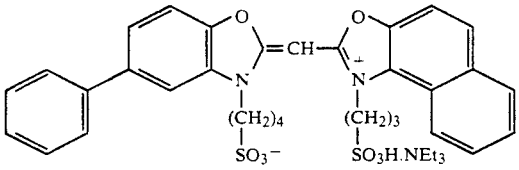
(I-30)
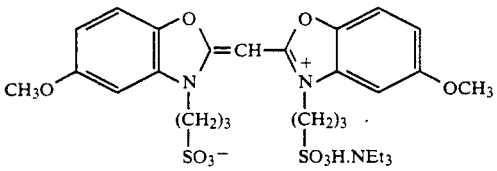
(I-31)
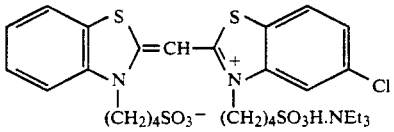
(I-32)
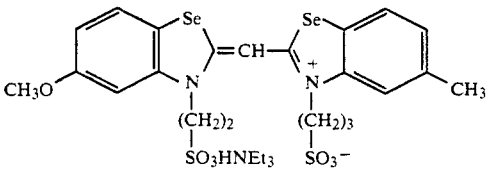

-continued
(I-33)
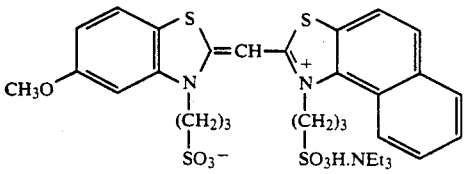
(I-34)
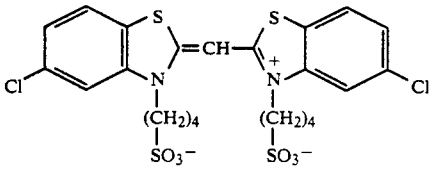
(I-35)
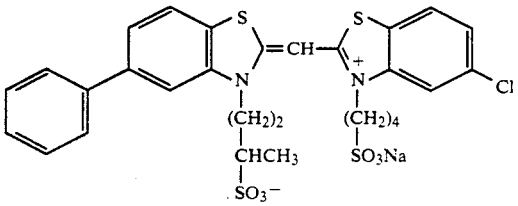
(I-36)
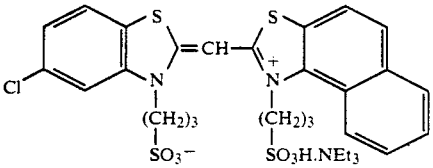
(I-37)
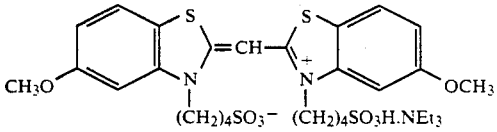
(I-38)
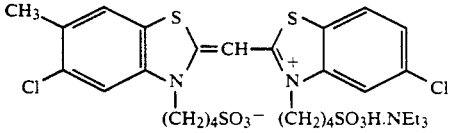
(I-39)
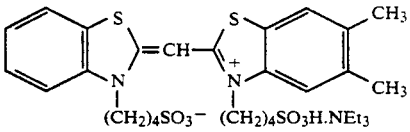
(I-40)
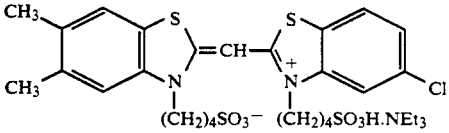
(I-41)
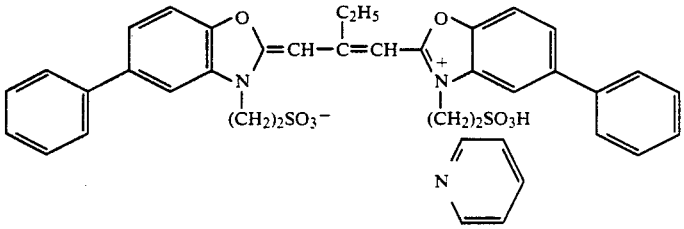

-continued
(I-42)
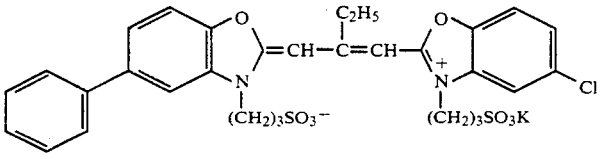
(I-43)
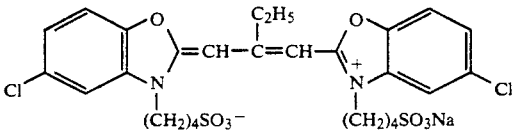
(I-44)
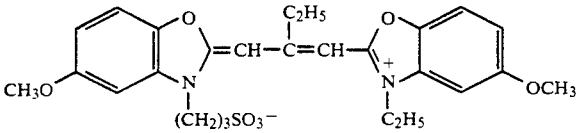
(I-45)
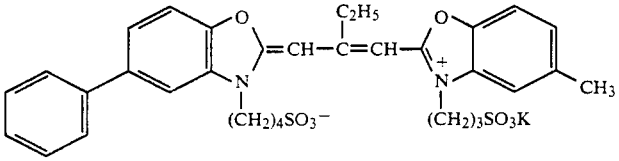
(I-46)
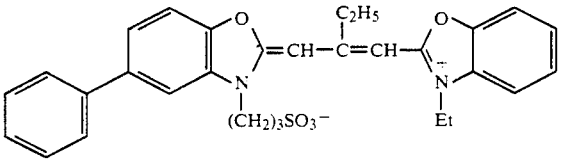
(I-47)
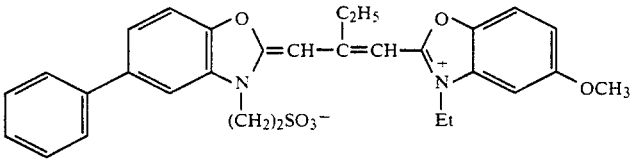
(I-48)
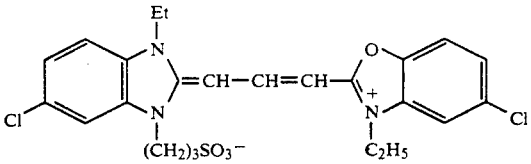
(I-49)
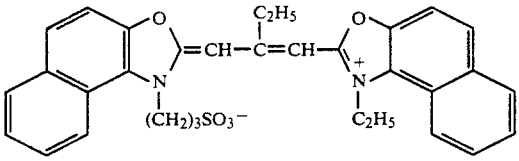
(I-50)
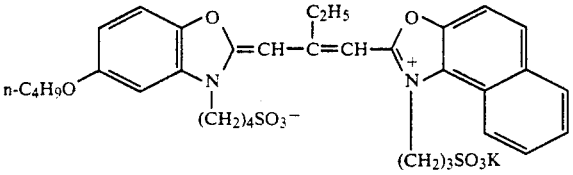

-continued (I-51)

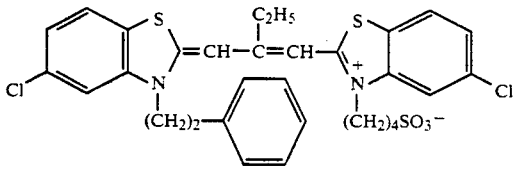

(I-52)

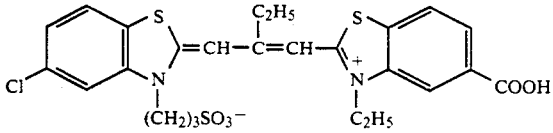

(I-53)

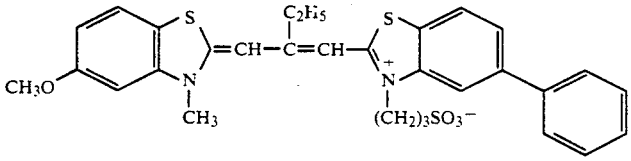

(I-54)

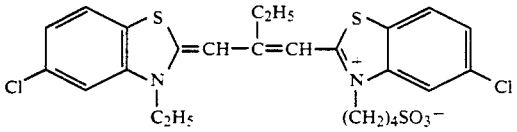

(I-55)

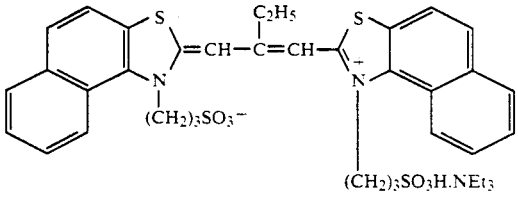

(I-56)

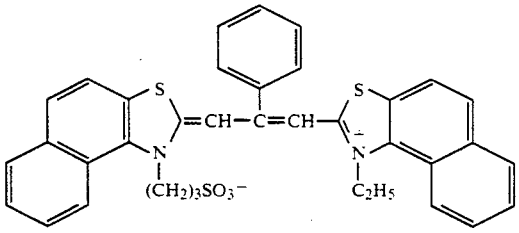

In a preferred embodiment of the method of the present invention for manufacturing a silver halide emulsion, a nitrogen-containing heterocyclic compound is added to the emulsion between the time ٦ spectral sensitizing dye which is sensitive to a red light range, is added to the emulsion and the time a spectral sensitizing dye which is sensitive to a blue light or green light range is added to the emulsion. With this embodiment, the gradation corresponding to the blue light range or green light range may be made harder.

The nitrogen-containing heterocyclic compound may be, for example, a nucleic acid such as RNA or a decomposed product thereof (for example, adenine, guanine, cytosine, uracil), or an azaindene compound of the following general formulae (IIa) and (IIb), respectively:

(IIa)

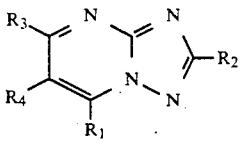

wherein R1, R2, R3 and R4 may be same or different and each represents a hydroxyl group, an alkyl group, an alkenyl group, an aryl group, a cyano group, an ureido group, an amino group, a halogen atom, or a hydrogen atom; provided that the compounds of formula (IIa) contain one or two hydroxyl groups.

The examples of the alkyl group, alkenyl group, aryl group, ureido group and amino group are the same as those of the R group of the following formula (IIIa). Especially preferred substituents to the alkyl group are an aryl group, an alkoxycarbonyl group, a carbamoyl group, a cyano group, an amino group and/or a sulfonamido group.

The R3 and R4 groups may be bonded to each other to form a 5-membered or 6-membered saturated or unsaturated ring.

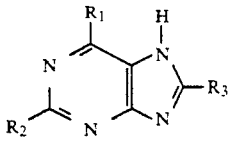

(IIb)

wherein R1, R2 and R3 have the same meanings as R1 and R2 in formula (IIa); but there is no requirement that the compounds of formula (IIb) have at least one or two hydroxyl groups.

The amount of the nitrogen-containing heterocyclic compound to be used in the present invention is from $1\times10^{-6}$ mol to $1\times10^{-2}$ mol, preferably $1\times10^{-5}$ mol to $1\times10^{-3}$ mol, per mol of silver halide.

Examples of the compounds of formulae (IIa) ad (IIb) are shown below.

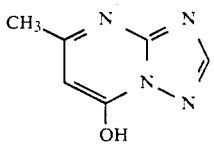

(II-1)

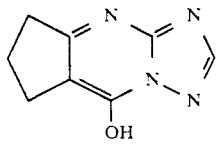

(II-2)

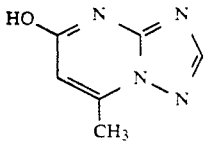

(II-3)

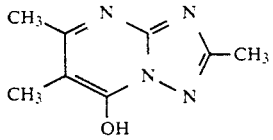

(II-4)

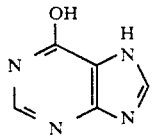

(II-5)

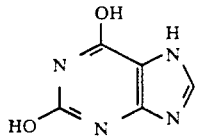

(II-6)

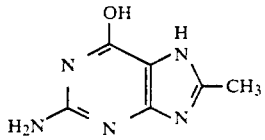

(II-7)

-continued

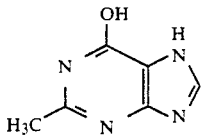

(II-8)

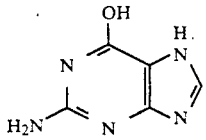

(II-9)

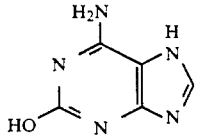

(II-10)

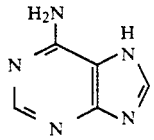

(II-11)

The silver halide emulsion of the present invention may further contain compounds other than the above-mentioned nitrogen-containing heterocyclic compounds, for the purpose of preventing fog of photographic materials during their manufacture or during their storage before development or during their development, or for the purpose of elevating the stability of the photographic properties of the materials. Such additional compounds are (1) antifoggants, for example, heterocyclic mercapto compounds, such as mercaptothiadiazoles, mercaptotetrazoles, mercaptobenzimidazoles, mercaptobenzothiazoles, mercaptopyrimidines and mercaptothiazoles, and (2) stabilizers, for example, heterocyclic mercapto compounds having a water-soluble group such as a carboxyl group or a sulfone group. Examples of these compounds include those described in U.S. Pat. No. 4,853,321 (col. 3-20) and JP-A-62-215272 (pages 51–69).

Mercaptotetrazole compounds which are especially preferred are added to the silver halide emulsion of the present invention during or after formation of silver halide grains therein or during or after chemical sensitization of the grains or during the coating of the emulsion, for the purpose of preventing fog of the emulsion or for the purpose of improving the processing-dependence thereof. Such mercaptotetrazoles can be selected from those of the following general formula (IIIa):

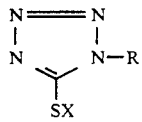

(IIIa)

wherein R represents an alkyl group, an alkenyl group or an aryl group; and X represents a hydrogen atom, an alkali metal atom, an ammonium group, or a precursor thereof.

The alkali metal atom includes, for example, a sodium atom and a potassium atom; and the ammonium group includes, for example, trimethylammonium chloride group, and dimethylbenzylammonium chloride group.

The precursor group may become a hydrogen atom or an alkali metal atom under an alkaline condition. For example, it includes an acetyl group, a cyanoethyl group, and a methanesulfonylethyl group.

The alkyl group and alkenyl group represented by R may be substituted or unsubstituted and may also include alicyclic groups. Examples of the substituents in the substituted alkyl group include a halogen atom, an alkoxy group, an aryl group, an acylamino group, an alkoxycarbonylamino group, an ureido group, a hydroxyl group, an amino group, a heterocyclic group, an acyl group, a sulfamoyl group, a sulfonamido group, a thioureido group, a carbamoyl group, and additionally a carboxylic acid group, a sulfonic acid group and salts thereof.

The ureido group, thioureido group, sulfamoyl group, carbamoyl group and amino group may be unsubstituted, or N-alkyl-substituted or N-aryl-substituted. Examples of the aryl group represented by R include an unsubstituted phenyl group and a substituted phenyl group. Substituents of the substituted phenyl group include alkyl groups as well as the substituents of the above-mentioned substituted alkyl groups.

Preferred mercaptothiadiazole compounds are those of the following general formula (IVa):

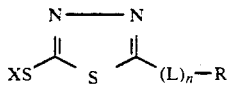

(IVa)

wherein L represents a divalent linking group; and R represents a hydrogen atom, an alkyl group, an alkenyl group or an aryl group. Examples of the alkyl group and alkenyl group represented by R and X are the same as those for formula (IIIa).

Examples of the divalent linking group L in formula (IVa) include —N(R0)—, —S—, —N(R0)SO2—, —N(R1)—CO—N(R2)—, —N(R0)CO—, and —N(R-1)—CS—N(R2)—. In these groups, n represents 0 or 1; and R0, R1 and R2 each represents a hydrogen atom, an alkyl group or an aralkyl group.

In addition to these compounds, mercaptobenzimidazoles are also preferably used in the invention.

These compounds may be added to the silver halide emulsion during or after formation of silver halide grains therein or during or after chemical sensitization of the grains or during the coating of the emulsion.

Preferred examples of these compounds are mentioned below.

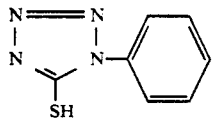
(III-1)

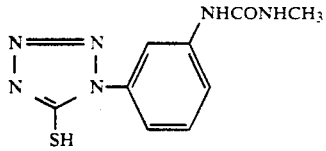

(III-2)

-continued

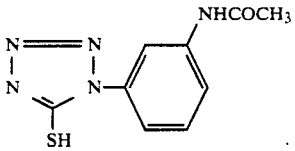

(III-3)

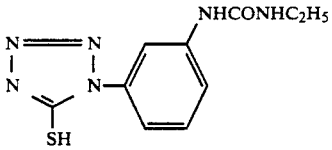

(III-4)

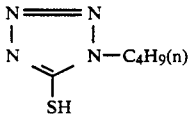

(III-5)

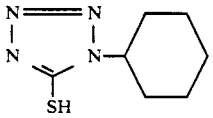
(III-6)

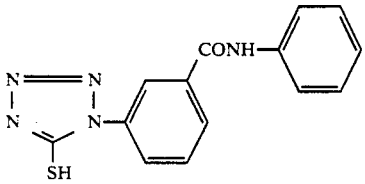

(III-7)

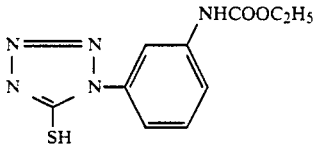

(III-8)

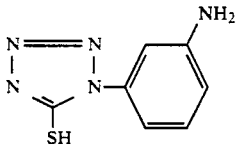

(III-9)

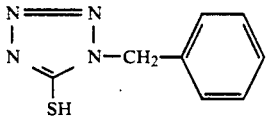

(III-10)

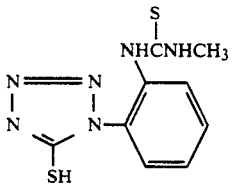

(III-11)

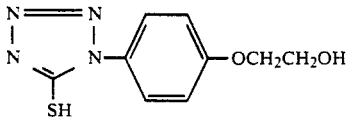

(III-12)

-continued (IV-1)

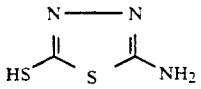

(IV-2)

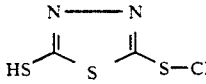

(IV-3)

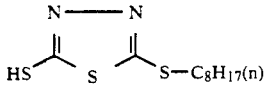

(IV-4)

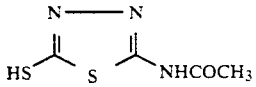

(IV-5)

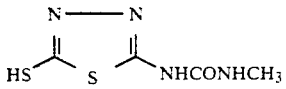

(IV-6)

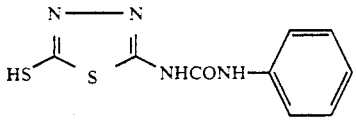

When the present invention is applied to color photographic materials, those materials generally contain a yellow coupler, a magenta coupler and a cyan coupler which form yellow, magenta and cyan dyes, respectively, after being coupled with the oxidation product of an aromatic amine color-developing agent.

Cyan couplers, magenta couplers and yellow couplers which are preferably employed in the present invention are those of the following formulae (C-I), (C-II), (M-I), (M-II) and (Y):

(C-I)

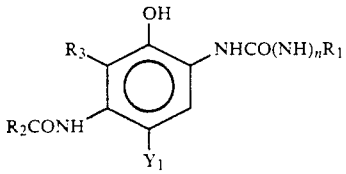

(C-II)

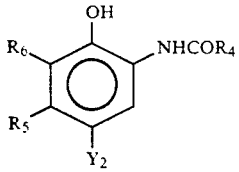

(M-I)

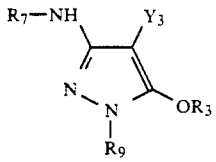

(M-II)

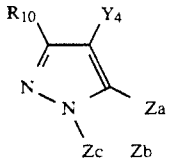

-continued (Y)

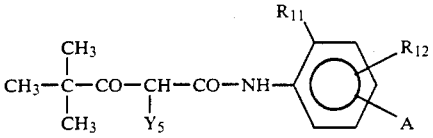

In formulae (C-I) and (C-II), $R_1$, $R_2$ and $R_4$ each represents a substituted or unsubstituted aliphatic, aromatic or heterocyclic group; $R_3$, $R_5$ and $R_6$ each represents a hydrogen atom, a halogen atom, an aliphatic group, an aromatic group or an acylamino group; and $R_3$ may form with $R_2$ a nitrogen-containing 5-membered or 6-membered non-metallic atomic group; $Y_1$ and $Y_2$ each represents a hydrogen atom or a group capable of being split off from the formula by a coupling reaction with the oxidation product of a developing agent; and n represents 0 or 1.

In formula (C-II), $R_5$ is preferably an aliphatic group, for example, a methyl group, an ethyl group, a propyl group, a butyl group, a pentadecyl group, a tertbutyl group, a cyclohexyl group, a cyclohexylmethyl group, a phenylthiomethyl group, a dodecyloxyphenylthiomethyl group, a butanamidomethyl group or a methoxymethyl group.

Preferred examples of the cyan couplers of the above-mentioned formulae (C-I) and (C-II) are mentioned below.

Specifically, in formula C-I), $R_1$ is preferably an aryl group or a heterocyclic group, more preferably an aryl group substituted by one or more substituents selected from a halogen atom, an alkyl group, an alkoxy group, an aryloxy group, an acylamino group, an acyl group, a carbamoyl group, a sulfoamido group, a sulfamoyl group, a sulfonyl group, a sulfamido group, an oxycarbonyl group and a cyano group.

In formula (C-I), where $R_3$ and $R_2$ do not form a ring, $R_2$ is preferably a substituted or unsubstituted alkyl or aryl group, especially preferably a substituted aryloxy-substituted alkyl group. The. $R_3$ group is preferably a hydrogen atom.

In formula (C-II), $R_4$ is preferably a substituted or unsubstituted alkyl or aryl group, especially preferably a substituted aryloxy-substituted alkyl group.

In formula (C-II), $R_5$ is preferably an alkyl group having from 2 to 15 carbon atoms or a methyl group having substituent(s) with one or more carbon atoms. Preferred examples of the substituent(s) of the substituted methyl group are an arylthio group, an alkylthio group, an acylamino group, an aryloxy group and an alkyloxy group.

In formula (C-II), $R_5$ is more preferably an alkyl group having from 2 to 15 carbon atoms, especially preferably an alkyl group having from 2 to 4 carbon atoms.

In formula (C-II), $R_6$ is preferably a hydrogen atom or a halogen atom, especially preferably a chlorine atom or fluorine atom. In formulae (C-I) and (C-II), $Y_1$ and $Y_2$ each is preferably a hydro9en atom, a halo9en atom, an alkoxy group, an aryloxy group, an acyloxy group or a sulfonamido group.

In formula (M-I), $R_7$ and $R_9$ each represents an aryl group; $R_8$ represents a hydrogen atom, an aliphatic or aromatic acyl group, or an aliphatic or aromatic sulfonyl group; and $Y_3$ represents a hydrogen atom or a split-off group. The aryl group represented by $R_7$ or $R_9$ may be substituted and is preferably an optionally substituted phenyl group. The aryl group of $R_7$ and $R_9$ has the same substituents as does $R_1$ in formula (C-I) above. When the aryl group has two or more substituents, they may be same or different. The $R_8$ group is preferably a hydrogen atom, or an aliphatic acyl or sulfonyl group, especially preferably a hydrogen atom. $Y_3$ is preferably is a split-off group which may be split off from the formula via a sulfur, oxygen or nitrogen atom. For instance, the sulfur atom-split off groups described in U.S. Pat. No. 4,351,897 and International Patent Application Laid-Open No. W088/04795 are especially preferred.

In formula (M-II), $R_{10}$ represents a hydrogen atom or a substituent. $Y_4$ represents a hydrogen atom or a split-off group, and it is especially preferably a halogen atom or an arylthio group. Za, Zb and Zc each represents a methine group, a substituted methine group, =N— or —NH—. Either the Za—Zb bond of the Zb—Zc bond is a double bond, and the other is a single bond. When Zb—Zc bond is a carbon-carbon double bond, it may be a part of an aromatic ring. The formula may form a dimer or a higher polymer at $R_{10}$ or $Y_4$. When Za, Zb or Zc is a substituted methine group, the formula may also form a dimer or a higher polymer at the substituted methine group.

Among pyrazoloazole couplers of formula (M-II), the imidazo[1,2-b]pyrazoles described in U.S. Pat. No. 4,500,630 are preferred as giving color dyes having small yellow side-absorption and high light-fastness. The pyrazolo[1,5-b][1,2,4]triazoles described in U.S. Pat. No. 4,540,654 are especially preferred.

Preferred also are the pyrazolotriazole couplers in which a branched alkyl group is directly bonded at the 2-, 3- or 6-position of the pyrazolotriazole ring, described in JP-A-61-65245; the pyrazoloazole couplers having a sulfonamido group in the molecule, described in JP-A-61-65246; the pyrazoloazole couplers having an alkoxyphenylsulfonamido ballast group, described in JP-A-61- 47254; and the pyrazolotriazole couplers having an alkoxy group or aryloxy group at the 6-position, described in European Patent Laid-Open Nos. 226,849 and 294,785.

In formula (Y), $R_{11}$ represents a halogen atom, an alkoxy group, a trifluoromethyl group, or an aryl group; $R_{12}$ represents a hydrogen atom, a halogen atom, or an alkoxy group; and A represents —$NHCOR_{13}$, —$NHSO_2$—$R_{13}$, —$SO_2NHR_{13}$, —$COOR_{13}$, or —$SO_2N(R_{14})$—$R_{13}$. $R_{13}$ and $R_{14}$ each represents an alkyl group, an aryl group or an acyl group. $Y_5$ represents a split-off group. The groups of $R_{12}$, $R_{13}$ and $R_{14}$ may further be substituted. Examples of the substituents include the substituents of $R_1$ of formula (C-I). The split-off group of $Y_5$ is preferably one which may split off from the formula via an oxygen atom or a nitrogen atom, and it is more preferably a nitrogen atom-split off group.

Examples of the couplers of formulae (C-I), (C-II), (M-I), (M-II) and (Y) are shown below.

(C-1)

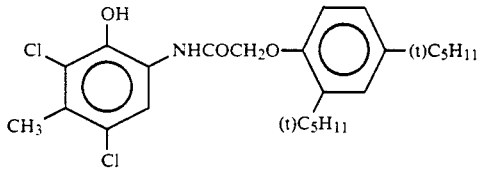

(C-2)

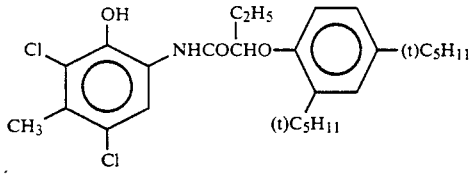

(C-3)

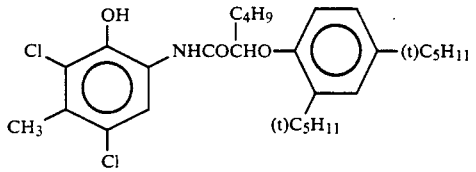

(C-4)

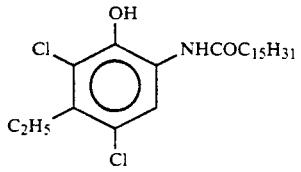

-continued
(C-5)
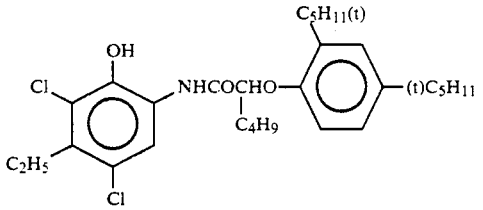
(C-6)
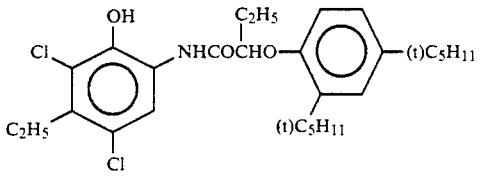
(C-7)
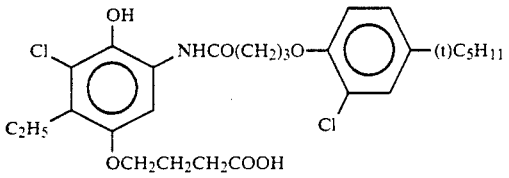
(C-8)
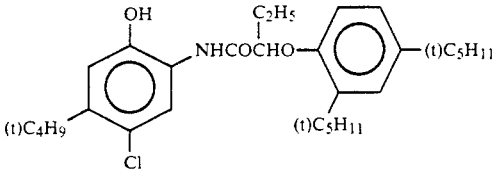
(C-9)
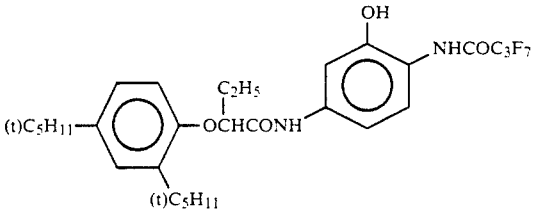
(C-10)
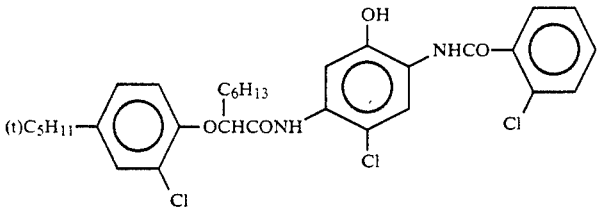
(C-11)
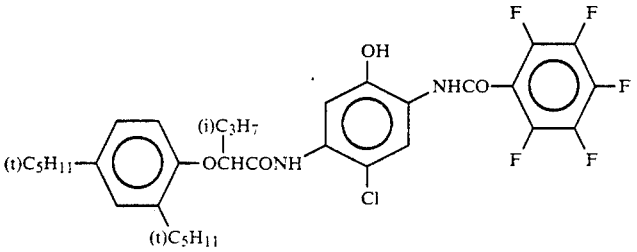

-continued
(C-12)
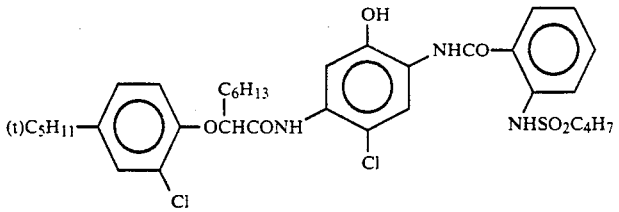
(C-13)
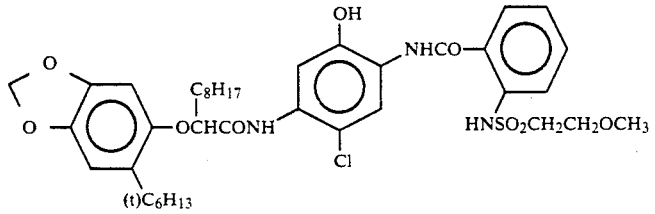
(C-14)
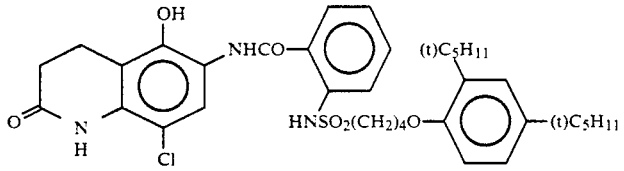
(C-15)
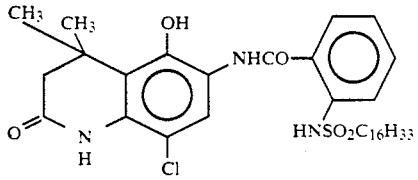
(C-16)
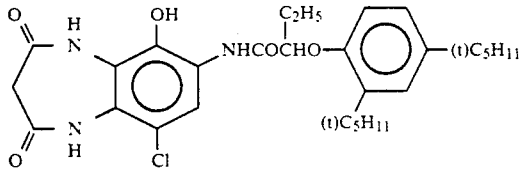
(C-17)
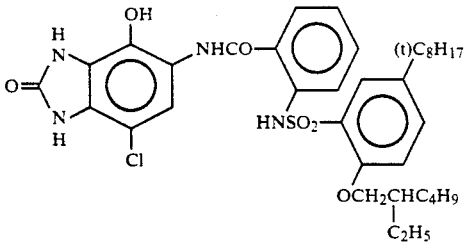
(C-18)
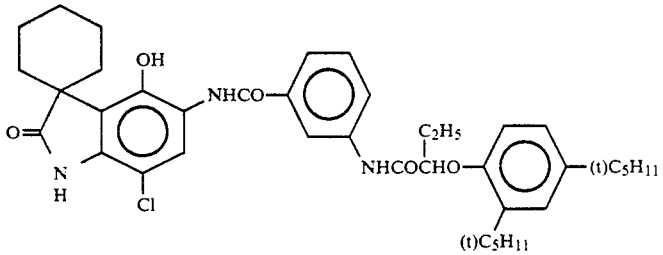

-continued
(C-19)
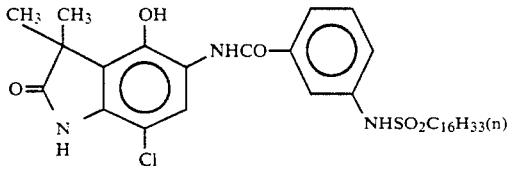
(C-20)
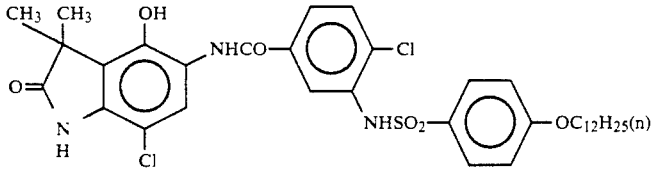
(C-21)
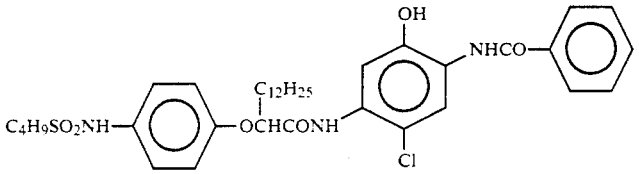
(C-22)
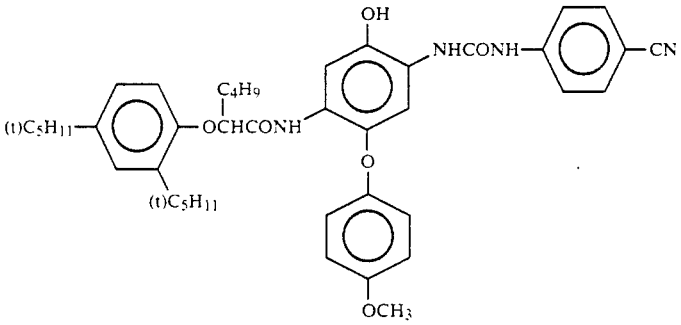
(M-1)
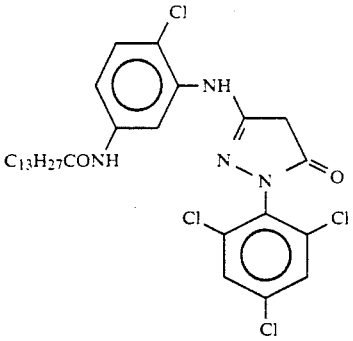
(M-2)
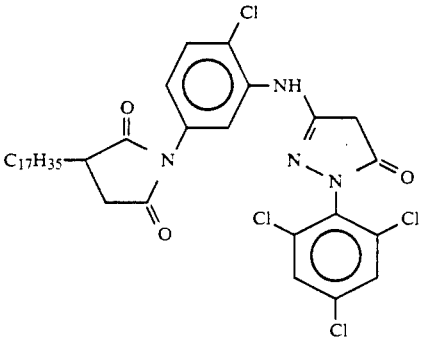

-continued
(M-3)
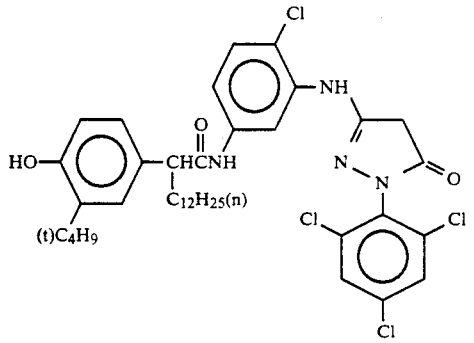
(M-4)
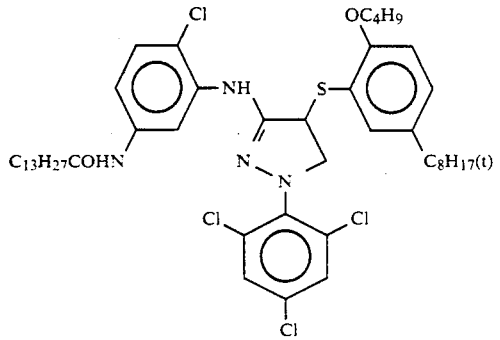
(M-5)
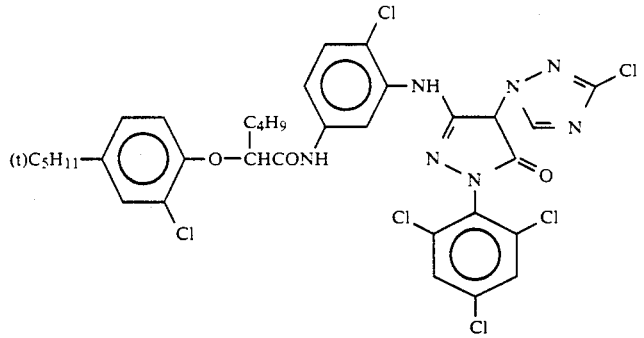
(M-6)
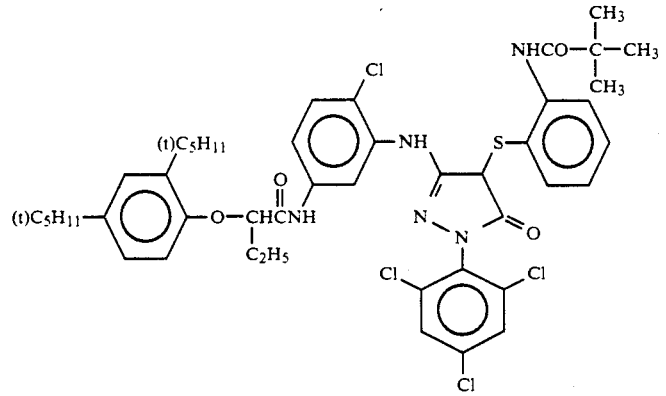

-continued
(M-7)
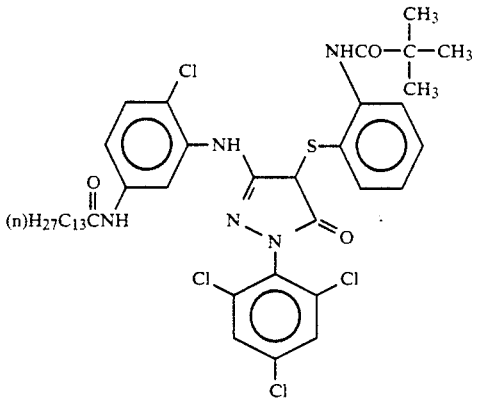
(M-8)
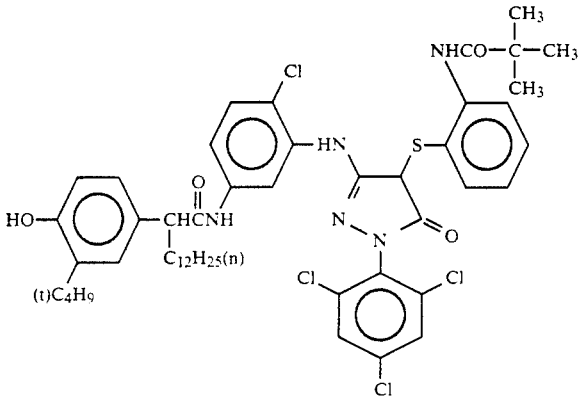

| Compound | $R_{10}$ | $R_{15}$ | $Y_4$ |
|---|---|---|---|
| | | 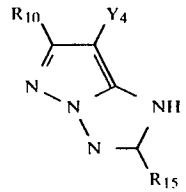 | |
| M-9 | $CH_3$— | 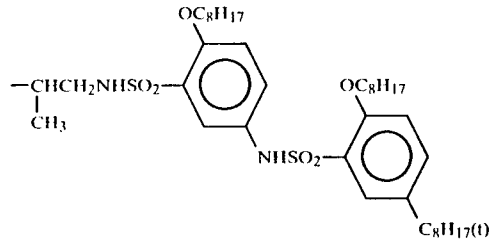 | Cl |
| M-10 | $CH_3$— | 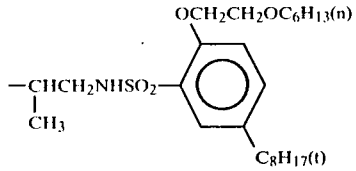 | Cl |
| M-11 | $(CH_3)_3C$— | 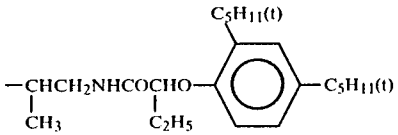 | 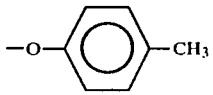 |
| M-12 | 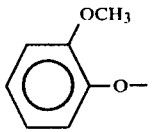 | 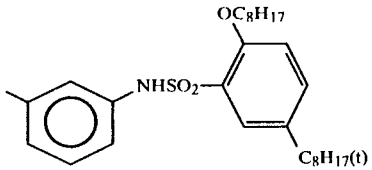 | 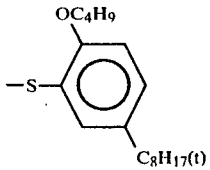 |

-continued
| Compound | $R_{10}$ | $R_{15}$ | $Y_4$ |
|---|---|---|---|
| M-13 | $CH_3$— | 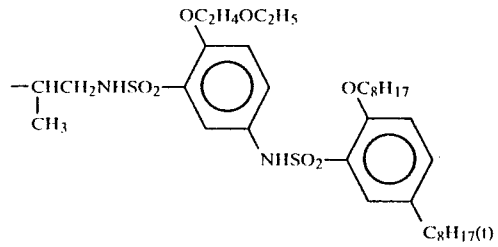 | Cl |
| M-14 | $CH_3$— | 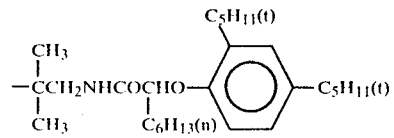 | Cl |
| M-15 | $CH_3$— | 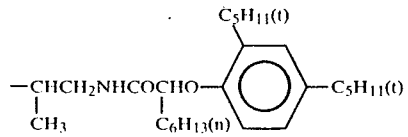 | Cl |
| M-16 | $CH_3$— | 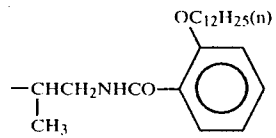 | Cl |
| M-17 | $CH_3$— | 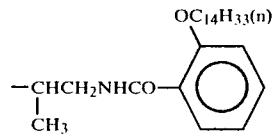 | Cl |

-continued
| Compound | $R_{10}$ | $R_{15}$ | $Y_4$ |
|---|---|---|---|
| M-18 | 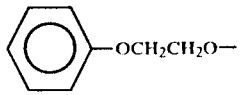 | 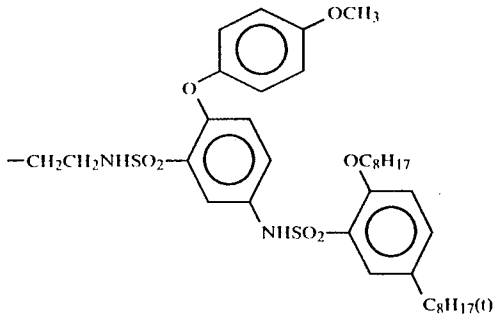 | 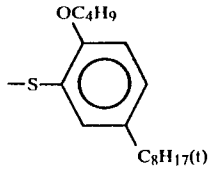 |
| M-19 | $CH_3CH_2O-$ | " | " |
| M-20 | 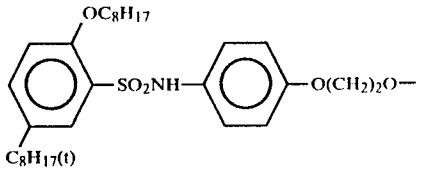 | 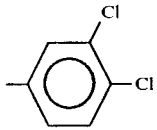 | 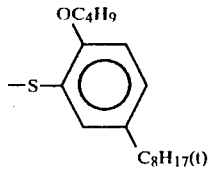 |
| M-21 | 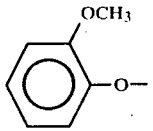 | 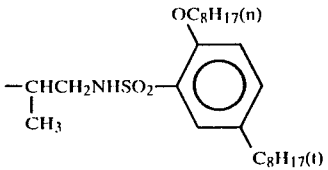 | Cl |
| | 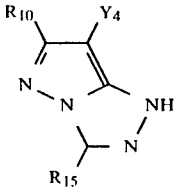 | | |
| M-22 | $CH_3-$ | 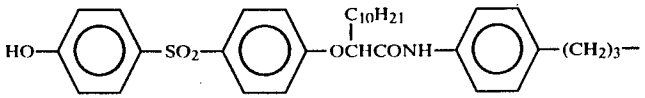 | Cl |

-continued

| Compound | $R_{10}$ | $R_{15}$ | $Y_4$ |
|---|---|---|---|
| M-23 | " | $(n)C_6H_{13}$ \ $CHCH_2SO_2-(CH_2)_2-$ / $(n)C_8H_{17}$ | " |
| M-24 | $CH_3$ \ $CH-$ / $CH_3$ | $OC_4H_9$; $SO_2-(CH_2)_3-$; $C_8H_{17}(t)$ | " |
| M-25 | $-(CH-CH_2)_{50}-(CH_2-C)_{50}-$ ($CH_3$; $COOCH_2CH_2OCH_3$; $CONH-$) | $CH_3-CH-$ ($CH_2NHSO_2CH_3$) | " |
| M-26 | $-O-$ | $OC_8H_{17}$; $-(CH_2)_2NHSO_2-$; $C_8H_{17}(t)$ | Cl |
| M-27 | $CH_3-$ | $CH_3$; $CH_3$; $CH_3$; $NHCOCHO-$ ($(n)C_{10}H_{21}$); $SO_2$; $OCH_2$ | " |
| M-28 | $(CH_3)_3C-$ | $CH_3$; $CH_3$; $CH_3$; $C_5H_{11}(t)$; $NHCOCHO-$ ($C_4H_9(n)$); $C_5H_{11}(t)$ | " |

-continued
| Compound | $R_{10}$ | $R_{15}$ | $Y_4$ |
|---|---|---|---|
| M-29 | 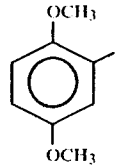 | 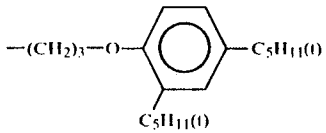 | Cl |
| M-30 | $CH_3$— | $(n)C_{18}H_{37}$<br>\|<br>—CH—$NCOCH_2CH_2COOH$<br>\|<br>$C_2H_5$ | Cl |

(Y-1)
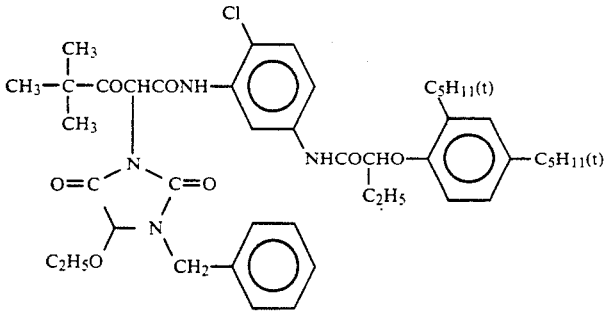
(Y-2)
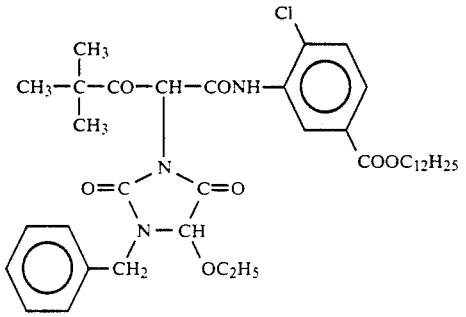
(Y-3)
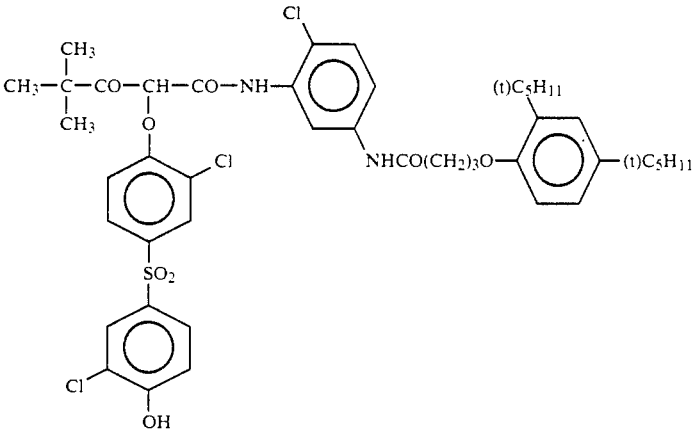
(Y-4)
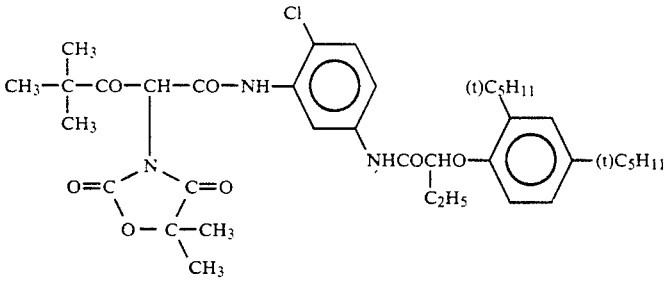
(Y-5)
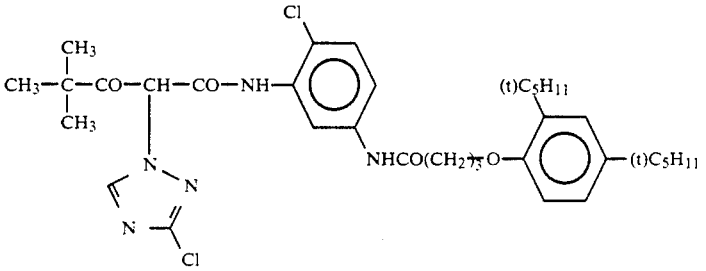

-continued (Y-6)

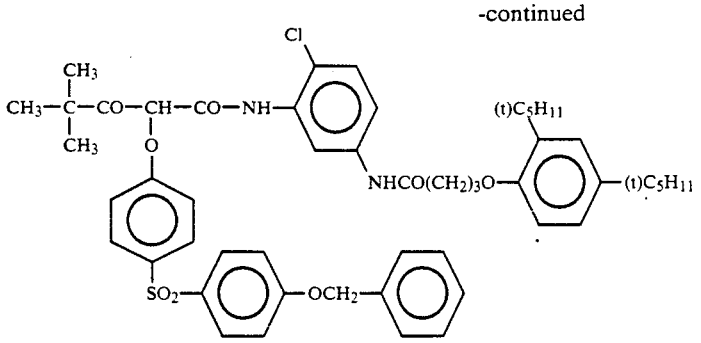

(Y-7)

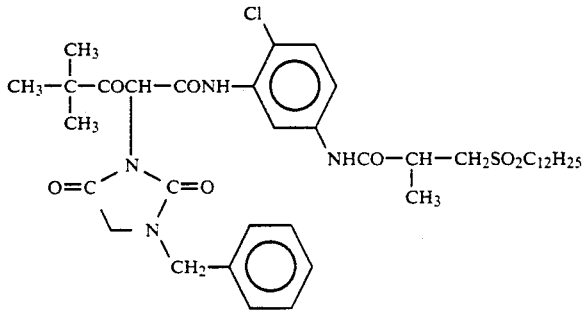

(Y-8)

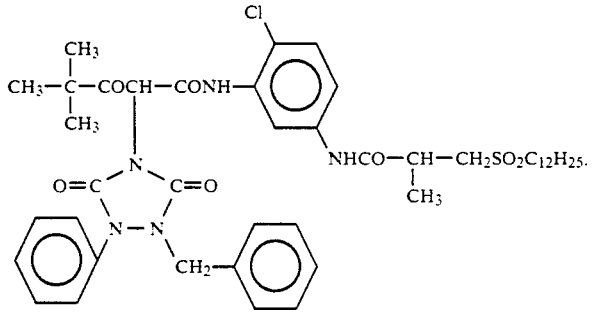

(Y-9)

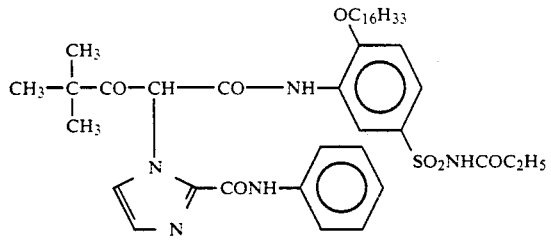

The color photographic material of the present invention is composed of at least one blue-sensitive silver halide emulsion layer, at least one green-sensitive silver halide emulsion layer and at least one red-sensitive silver halide emulsion layer, coated on a support. In general, the emulsion layers are coated on a support in this order, but any other order may also be employed. An infrared-sensitive silver halide emulsion layer may be used in place of at least one of the green-sensitive emulsion layer and the blue-sensitive emulsion layer. The infrared-sensitive silver halide emulsion layer may also be used with at least one blue-sensitive emulsion layer, at least one green-sensitive emulsion layer and at least one red-sensitive emulsion layer.

Each of the light-sensitive emulsion layers contains a silver halide emulsion having a sensitivity in a determined wavelength range and a color coupler capable of forming a dye, which has a complementary color to the light to which the emulsion is sensitive, that is, a yellow dye to a blue light, a magenta dye to a green light, and a cyan dye to a red light. Thus, color reproduction on the photographic material is possible by a subtractive color process. The combination of the light-sensitive layer and the color hue of the dye to be formed from the coupler is not limited to the above-mentioned combination, but any other constitution may be possible.

The amount of the coupler of the above-mentioned formulae (C-I) to (Y) to be included in the silver halide emulsion to constitute a light-sensitive layer is generally from 0.1 to 1.0 mol, preferably from 0.1 to 0.5 mol, per mol of the silver halide in the emulsion.

Various techniques are known for adding the above-mentioned couplers to the light-sensitive layer. In general, a coupler may be added to the layer by an oil-in-water dispersion method, which is known as an oil-protecting method. In accordance with the method, the coupler is dissolved in a solvent and then dispersed in a surfactant-containing aqueous gelatin solution by emulsification. Alternatively, water or an aqueous gelatin solution may be added to a surfactant-containing coupler solution to give an oil-in-water dispersion after phase conversion. When an alkali-soluble coupler is used, it may be added to the photographic emulsion by a so-called Fisher dispersion method. If used, the low-boiling point organic solvent may be removed from the coupler dispersion by distillation, noodle washing or ultrafiltration, and thereafter the resulting coupler dispersion may be added to the photographic emulsion.

As the dispersion medium for the coupler, a high boiling point organic solvent and/or a water-insoluble polymer compound having a dielectric constant of from 2 to 20 (at 25° C.) and a refractive index of from 1.5 to 1.7 (at 25° C.) are/is preferably used.

As such a high boiling point organic solvent, preferred are those of the following general formulae (A) to (E).

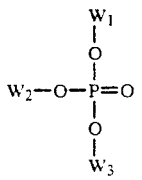
(A)

$W_1-COO-W_2$ (B)

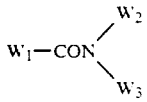
(C)

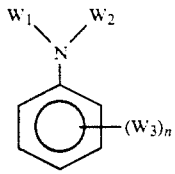
(D)

$W_1-O-W_2$ (E)

In these formulae, $W_1$, $W_2$ and $W_3$ each represents a substituted or unsubstituted alkyl, cycloalkyl, alkenyl, aryl or heterocyclic group; $W_4$ represents $W_1$, $OW_1$ or $SW_1$; and n represents from 1 to 5. When n is 2 or more, the plurality $W_4$ groups may be same or different. In formula (E), $W_1$ and $W_2$ may form a condensed ring.

In addition to the compounds of formulae (A) to (E), any other water-immiscible compounds having a melting point of 100° C. or lower and a boiling point of 140° C. or higher may be used as high boiling point organic solvents for couplers, provided that it is a good solvent to couplers. In any event, the high boiling point organic solvents which are appropriate for the present invention have a melting point of preferably 80° C. or lower, and they have a boiling point of preferably 160° C. or higher, more preferably 170° C. or higher.

The details of such high boiling point organic solvents are described in JP-A-62-215272, from page 137, right lower column to page 144, right upper column.

Additionally, it is also possible that the coupler of the present invention is infiltrated into a loadable latex polymer (for example, U.S. Pat. No. 4,203,716) in the presence or absence of the above-mentioned high boiling point organic solvents or is dissolved in a water-insoluble and organic-soluble polymer, before being dispersed in an aqueous hydrophilic colloid solution by emulsification.

Preferably, the homopolymers or copolymers described in International Patent Application Laid-Open No. WO88/00723, pages 12 to 30 are used for this purpose. In particular, use of acrylamide polymers is especially preferred in view of the function thereof of stabilizing the image to be formed.

The photographic material of the present invention may contain a hydroquinone derivative, an aminophenol derivative, a gallic acid derivative or an ascorbic acid derivative, as a color-fogging inhibitor.

The photographic material of the present invention may contain various anti-fading agents. For instance, anti-fading agents to cyan, magenta and/or yellow images, which are appropriate for the present invention include hindered phenols such as hydroquinones, 6-hydroxychromans, 5-hydroxycoumarans, spirochromans, p-alkoxyphenols and bisphenols; gallic acid derivatives; methylenedioxybenzenes; aminophenols; hindered amines; as well as ether or ester derivatives thereof prepared by silylating or alkylating the phenolic hydroxyl group in those compounds. In addition, metal complexes such as (bissalicylaldoximato)nickel complexes and (bis-N,N-dialkyldithiocarbamato)nickel complexes may also be employed.

Examples of the organic anti-fading agents appropriate for the present invention are mentioned in the following patent publications: hydroquinones are described in U.S. Pat. Nos. 2,360,290, 2,418,613, 2,700,453, 2,701,197,l 2,728,659, 2,732,300, 2,735,765, 3,982,944 and 4,430,425, and British Patent 1,363,921, U.S. Pat. Nos. 2,710,801 and 2,816,028; 6-hydroxychromans, 5-hydroxycoumarans and spirochromans, in U.S. Pat. Nos. 3,432,300, 3,573,050, 3,574,627, 3,698,909 and 3,764,337, and JP-A-52-152225; spiroindanes, in U.S. Pat. No. 4,360,589; p-alkoxyphenols are in U.S. Pat. No. 2,735,765, British Patent 2,066,975, JP-A-59-10539 and JP-B-57-19765; hindered phenols, in U.S. Pat. No. 3,700,455, JP-A-52-72224, U.S. Pat. No. 4,228,235 and JP-B-52 6623; gallic acid derivatives, methylenedioxybenzenes and aminophenols, in U.S. Pat. Nos. 3,457,079 and 4,332,886, and JP-A-56-21144; hindered amines, in U.S. Pat. Nos. 3,336,135 and 4,268,593, British Patents 1,326,889, 1,354,313 and 1,410,846, JP-B-51-1420 and JP-A-58-114036, 59-53846 and 59-78344; and metal complexes, in U.S. Pat. Nos. 4.050,938 and 4,241,155 and British Patent 2,027,731(A).

In general, these compounds are added to light-sensitive layers in an amount of from 5 to 100% by weight to the corresponding color couplers by co-emulsifying them with the couplers, whereby the intended object is attained.

To prevent deterioration of a cyan color image by heat and especially by light, it is effective to incorporate an ultraviolet absorbent in the cyan coloring layer and in both the adjacent layers.

Appropriate ultraviolet absorbents for this purpose are aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamate compounds (for example, those described in U.S. Pat. Nos. 3,705,805 and 3,707,395), butadiene compounds (for example, those described in U.S. Pat. No. 4,045,229), and benzoxazole compounds (for example, those described in U.S. Pat. Nos. 3,406,070, 3,677,672 and 4,371,307). Additionally, ultraviolet-absorbing couplers (for example, cyan dye-forming alpha-naphthol couplers), as well as ultraviolet-absorbing polymers, may also be used for this purpose. Such ultraviolet absorbents may be mordanted in particular layer.

Above all, the above-mentioned aryl group-substituted benzotriazole compounds are especially preferred.

In accordance with the present invention, the following compounds are preferably employed together with the above-mentioned couplers. In particular, such compounds are especially preferably employed in combination with pyrazoloazole couplers.

Specifically, compounds (F) which may chemically bond with the aromatic amine developing agent which remains after color development to give a chemically inactive and substantially colorless compound, and/or compounds (G) which may chemically bond with the oxidation product of the aromatic amine developing agent which remains after color development to give a chemically inactive and substantially colorless compound, are preferably employed simultaneously or singly. Employment of such compounds is preferred, for example, to prevent stains caused by the formation of colored dyes resulting from the reaction between the developing agent or the oxidation product thereof which remains in the film and the coupler also remaining therein during storage of the processed material, and also to prevent other harmful side-reactions.

Preferred as compounds (F) are those which react with p-anisidine with a secondary reaction speed constant k2 (in trioctyl phosphate at 80° C.) of from 1.0 liter/mol.sec to $1\times10^{-5}$ liter/mol·sec. The secondary reaction speed constant can be measured by the method described in JP-A-3-158545.

If the value k2 is above this range, the compounds themselves would be unstable and would often react with the gelatin and water to decompose. On the other hand, if it is below this range, the reaction speed of the compound with the remaining amine .developing agent would low and, as a result, the object of the present invention to prevent the harmful side effects of the residual aromatic amine developing could not be attained.

More preferred examples of the compounds (F) are those represented by the following formula (FI) or (FII).

$$R_1-(A)_n-X \quad \text{(FI)}$$

$$R_2-CB=Y \quad \text{(FII)}$$

In these formulae, $R_1$ and $R_2$ each represents an aliphatic group, an aromatic group or a heterocyclic group; n represents 1 or 0; A represents group capable of reacting with an aromatic amine developing agent to form a chemical bond; X represents a group capable of reacting with an aromatic amine developing agent and thereby splitting off from the formula; B represents a hydrogen atom, an aliphatic group, an aromatic group, a heterocyclic group, an acyl group or a sulfonyl group; and Y represents a group or accelerating addition of an aromatic amine developing agent to the compound of formula (FII). $R_1$ and X, and Y and $R_2$ or B may be bonded to each other to form a cyclic structure.

Typical methods of chemically reacting these compounds with the remaining aromatic amine developing agent are by substitution reaction and addition reaction.

Examples of the compounds of formulae (FI) and (FII) are described in JP-A-63-158545 and 62-283338 and European Patent Laid-Open Application Nos. 298,321 and 277,589 and are preferably employed in the present invention.

More preferred compounds (G) which chemically bond with the oxidation product of the aromatic amine developing agent which remains after color development to give a chemically inert and substantially colorless compound, are those represented by the following formula (GI):

$$R-Z \quad \text{(GI)}$$

wherein R represents an aliphatic group, an aromatic group or a heterocyclic group; and Z represents a nucleophilic group or a group capable of releasing a nucleophilic group after being decomposed in the photographic material. In the compounds of the formula (GI), Z is preferably a group having a nucleophilic $nCH_3I$ value (R. G. Pearson, et al., *J. Am. Chem. Soc.*, 90, 319 (1968)) of 5 or more or a group to be derived therefrom.

The examples of the compounds of formula (GI) described in European Patent Laid-Open Application No. 255,722, JP-A-62-143048 and 62-229145 and Japanese Patent Application Nos. 63-136724 and 62-214681 and European Patent Laid-Open Application No. 298,321 and 277,589 and are preferred in the present invention.

The details of the combination of the above-mentioned compounds (G) and compounds (F) are described in European Patent Laid-Open Application No. 277,589.

The photographic materials of the present invention may contain water-soluble dyes or dyes, which may be converted into water-soluble dyes by photographic processing, in the hydrophilic colloid layers as a filter dye or for the purpose of anti irradiation or anti-halation or for other purposes. Such dyes include oxonole dyes, hemioxonole dyes, styryl dyes, merocyanine dyes, cyanine dyes and azo dyes. In particular, oxonole dyes, hemioxonole dyes and merocyanine dyes are useful.

As the binder or protective colloid for the emulsion layers constituting the photographic material of the present invention, gelatin is most advantageous. However, any other hydrophilic colloids may also be used singly or in combination with gelatin.

The gelatin appropriate for the present invention may be either a lime-processed gelatin or an acid-processed gelatin. The details of preparation of various gelatins are described in, for example, Arthur Vais, *The Macromolecular Chemistry of Gelatin* (published by Academic Press, 1964).

The support for forming the photographic material of the present invention includes those transparent supports which are generally used in conventional photographic materials, such as cellulose nitrate film or polyethylene terephthalate film, as well as a reflective support. The latter reflective support is preferred in view of the object of the present invention.

The reflective support which can be employed in the present invention is preferably one which may improves reflectivity so that the color image as formed on the silver halide emulsion layer is made sharp. Such a reflective support may be a support prepared by coating a hydrophobic resin which contains a dispersion of a light-reflecting substance such as titanium oxide, zinc oxide, calcium carbonate or calcium sulfate on a support base, or a support made of a hydrophobic resin which contains a dispersion of the light-reflecting substance. Such reflective supports include a baryta paper, a polyethylene coated paper, a synthetic polypropylene paper, as well as a transparent support (e.g., glass sheet, polyester films such as polyethylene terephthalate, cellulose triacetate or cellulose nitrate, or polyamide films, polycarbonate films, polystyrene films or vinyl chloride resins) coated with a reflective layer or containing a reflecting substance.

In addition, a support having a metal surface with mirror reflectivity or secondary diffusion-reflectivity may also be used as a reflective support. In the reflective support of this type, the metal surface should have a spectral reflectivity of 0.5 or more in the visible wavelength range. Additionally, the metal surface is also preferably coarsened or is made diffusive and reflective by the application of a metal powder thereto. The metals appropriate for this purpose include aluminium, tin, silver, magnesium and alloys thereof. The surface may be derived from a metal plate, metal foil or thin metal layer obtained by rolling, vapor deposition or plating. Above all, the metal surface is preferably obtained by depositing a metal on the surface of a base by vapor deposition. The metal surface is preferably overcoated with a water-proofing resin layer, especially a thermoplastic resin layer. In a support which has the above-mentioned metal surface, the other surface may be coated with an antistatic layer. The details of the support of that type are described in, for example, JP-A-61-210346, 63-24247, 63-24251 and 63-24255.

The above-mentioned various supports may suitably be selected in accordance with the use and object of the photographic material.

As the above-mentioned light-reflecting substance, it is preferred that a white pigment is fully kneaded in the presence of a surfactant Pigment grains which are surface-treated with a 2- to 4-valent alcohol are also preferably employed.

When fine grains of a white pigment are incorporated into a support, the exclusive area ratio (%) of the grains per unit area is obtained most typically by dividing the observed area into the adjacent unit area of 6 μm x 6 μm and measuring the exclusive area ratio (%) (Ri) of the fine grains as projected to the unit area. The fluctuation coefficient of the exclusive area ratio (%) can be obtained as the ratio $s/\bar{R}$, that ratio being the standard deviation (s) of Ri to the mean value ($\bar{R}$) of Ri. The number (n) of the unit areas for measurement is preferably 6 or more. Accordingly, the fluctuation coefficient $s/\bar{R}$ can be obtained from the following formula:

$$\sqrt{\frac{\sum_{i=1}^{n}(R_i-\bar{R})^2}{n-1}} \Big/ \frac{\sum_{i=1}^{n}R_i}{n}$$

In accordance with the present invention, the fluctuation coefficient of the exclusive area ratio (%) of the fine pigment grains is preferably 0.15 or less, especially preferably 0.12 or less. If it is 0.08 or less, the dispersibility of the grains is substantially "uniform". The color photographic material of the present invention is preferably processed by color development, bleach-fixation, and rinsing in water (or stabilization). Bleaching and fixation may be effected separately in different bathes rather than occurring simultaneously in one bath.

The color developer for use in the present invention contains a known aromatic primary amine color developing agent.

Preferred examples of that agent are p-phenylenediamine derivatives. Specific examples thereof are mentioned below, but this list should not be regarded as limiting.

D-1: N,N-diethyl-p-phenylenediamine
D-2: 2-Amino-5-diehtylaminotoluene
D-3: 2-Amino-5-(N-ethyl-N-laurylamino)toluene
D-4: 4-[N-ethyl-N-(β-hydroxyethyl)amino]aniline
D-5: 2-Methyl-4-[-ethyl-N-(β-hydroxyethyl)amino]-aniline
D-6: 4-Amino-3-methyl-N-ethyl-N-[β-(methanesulfonamido)ethyl]-aniline
D-7: N-(2-amino-5-diethylaminophenyethyl)methanesulfonamide
D-8: N,N-dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Of these p-phenylenediamine derivatives, especially preferred is 4-amino-3-methyl-N-ethyl-N-[β-(methanesulfonamido)ethyl]aniline, (D-6).

The p-phenylenediamine derivatives may be in the form of salts such as sulfates, hydrochlorides, sulfites or p-toluenesulfonates. The amount of the aromatic primary amine developing agent to be used is preferably from about 0.1 g to about 20 g, more preferably from about 0.5 g to about 10 g, per liter of the developer.

In practice of the present invention, a developer which contains substantially no benzyl alcohol is preferable. A developer which contains substantially no benzyl alcohol is one preferably having a benzyl alcohol concentration of 2 ml/liter or less, more preferably 0.5 ml/liter or less. Most preferably, the developer contains no benzyl alcohol at all.

The developer for use in the present invention is preferred to contain substantially no sulfite ion. Sulfite ion has functions as a preservative for the developing agent, but additionally has a silver halide-solubilizing potential and a potential for reacting with the oxidation product of the developing agent to lower the dye-forming efficiency. Such potentials are presumed to be a factor in increasing the fluctuation of the photographic characteristics of the material in continuous processing thereof. The developer which contains substantially no sulfite ion is one having a sulfite ion concentration of preferably $3.0\times10^{-3}$ mol/liter or less, more preferably one containing no sulfite ion at all. In the present invention, however, an extremely small amount of sulfite ion may be incorporated into the concentrated developing agent stock as an antioxidant for the processing liquid kit, before that stock is prepared into a ready-to-use solution.

As mentioned above, it is preferred that the developer for use in the present invention contains substantially no sulfite ion, and more preferably, that the developer also contains substantially no hydroxylamine. This is because hydroxylamine is considered to function as a preservative for the developer and additionally to possess a silver-developing activity by itself whereby the fluctuation of the concentration of such hydroxylamine in the developer would have a great influence on the photographic characteristics of the material to be processed. The developer which contains substantially no hydroxylamine is one having a hydroxylamine concentration of $5.0\times10^{-3}$ mol/liter or less, more preferably one containing no hydroxylamine at all.

The developer for use in the present invention is preferred to contain an organic preservative in place of the above-mentioned hydroxylamine and sulfite ion.

The organic preservative to be used for this purpose includes any and every organic compounds which may retard the deteriorating speed of aromatic primary amine color developing agents when added to a processing solution for color photographic materials. Specifically, it includes organic compounds having the function of preventing oxidation of color developing agent by air. Above all, hydroxylamine derivatives (except hydroxylamine—the same shall apply hereunder), hydroxamic acids, hydrazines, hydrazides, phenol, α-hydroxyketones, α-aminoketones, saccharides, monoamines, diamines, polyamides, quaternary ammonium salts, nitroxy radicals, alcohols, oximes, diamine compounds and condensed polycyclic amines are especially effective organic preservatives. They are illustrated in JP-A-63-4235, 63-30845, 63-21647, 63-44655, 63-53551, 63-43140, 63-56654, 63-58346, 63-43138, 63-146041, 63-44657, 63-44656, U.S. Pat. Nos. 3,615,503, 2,494,903, JP-A-52-143020 nd JP-B-48-30496.

Other preservatives which may be incorporated into the developer for use in the present invention include various metals described in JP-A-57-44148 and 57-53749; salicylic acids described in JP-A-59-180588; alkanolamines described in JP-A-54-3532; polyethyleneimines described in JP-A-56-94349; and aromatic polyhydroxy compounds described in U.S. Pat. No. 3,746,544. In particular, alkanolamines such as triethanolamine, dialkylhydroxylamines such as diethylhydroxylamine, or hydrazine derivatives or aromatic polyhydroxy compounds are preferred.

Among the above-mentioned organic preservatives, hydroxylamine derivatives or hydrazine derivatives (hydrazines or hydrazides) are especially preferred. The details thereof are described in JP-A-1-97953, 1-186939, 1-186940 and 1-187557.

Combined use of both the above-mentioned hydroxylamine derivative or hydrazine derivative and the amine compound is more preferred for the purpose of improving the stability of the color developer and especially for improving the stability of the processing solution in continuous processing.

The amine compounds include the cyclic amines described in JP-A-63-239447, the amines described in JP-A-63-128340 and the amines described in JP-A-1-186939 and 1-187557.

The color developer for use in the present invention preferably contains a chloride ion in an amount of from $3.5\times10^{-2}$ to $1.5\times10^{-1}$ mol/liter. Especially preferably, the amount of the ion is from $4\times10^{-2}$ to $1\times10^{-1}$ mol/liter. If the chloride ion concentration is more than $1.5\times10^{-1}$ mol/liter, the excess ion would have the drawback of retarding the developing function of the developer. That result is unfavorable for attaining the object of the present invention which is a high maximum color density by a rapid development procedure. If the chloride ion concentration is less than $3.5\times10^{-2}$ mol/liter, the developer would be unfavorable for preventing fog.

The color developer for use in the present invention preferably contains a bromide ion in an amount of from $3.0\times10^{5}$ mol/liter to $1.0\times10^{-3}$ mol/liter. More preferably, the bromide ion concentration is from $5.0\times10^{-5}$ to $5.0\times10^{-4}$ mol/liter. If the bromide ion concentration is more than $1\times10^{-3}$ mol/liter, the developability of the developer would be retarded and the maximum density of the color dye to be formed in the material processed, as well as the sensitivity of the material, would be lowered. If, however, the bromide ion concentration is less than $3.0\times10^{-5}$ mol/liter, the developer could not sufficiently prevent fog.

The chloride ion and bromide ion may be directly added to the developer, or they may be dissolved out from the photographic material containing the same during development procedure.

When the ions are directly added to the color developer, the chloride ion-donating substance may be sodium chloride, potassium chloride, ammonium chloride, lithium chloride, nickel chloride, magnesium chloride, manganese chloride, calcium chloride and cadmium chloride. Among them, sodium chloride and potassium chloride are preferred.

The ions may be derived from the brightening agent as it is added to the developer.

The bromide ion-donating substance include sodium bromide, potassium bromide, ammonium bromide, lithium bromide, calcium bromide, magnesium bromide, manganese bromide, nickel bromide, cadmium bromide, cerium bromide and thallium bromide. Among them, potassium bromide and sodium bromide are preferred.

When the ions are released from the photographic material into the developer during the development procedure, they may be released from the emulsions of the material or they may be released from any others portion of the material.

The color developer can contain various developer components of known compounds, in addition to the above-mentioned components.

The color developer for use in the present invention preferably has a pH value of from 9 to 12, more preferably from 9 to 11.0.

In order to maintain the above-mentioned pH value range, various buffers are preferably added to the developer. Appropriate buffers for this purpose include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. In particular, carbonates, phosphates, tetraborates and hydroxybenzoates are preferred, as having a high solubility and an excellent buffering capacity at a pH of 9.0 or higher. In addition, these buffers have the further advantages that they have no bad influence (e.g., fog) on the photographic processing capacity of the developer when they are added to the developer and that they are low-priced. Accordingly, these buffers are preferable.

Specific examples of these buffers, include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydrpxybenzoate (sodium 5-sulfosalicylate) and potassium 5-sulfo-2-hydroxy-benzoate (potassium 5-sulfosalicylate). Other buffers are also possible.

The amount of the buffer to be added to the color developer is preferably 0.1 mol/liter or more, especially preferably from 0.1 mol/liter to 0.4 mol/liter.

In addition, the color developer may further contain various chelating agents to prevent precipitation of calcium or magnesium or to improve the stability of the color developer.

Examples of appropriate chelating agents include nitrilo-triacetic acid, diethylenetriamine-pentaacetic acid, ethylenediamine-tetraacetic acid, N,N,N-trimethylene-phosphonic acid, ethylenediamine-N,N,N',N'-tetramethylenephosphonic acid, trans-cyclohexanediamine-tetraacetic acid, 1,2-diaminopropane-tetraacetic acid, glycolether-diamine-tetraacetic acid, ethylenediamine-orthhydroxyphenylacetic acid, 2-phosphono-butane-1,2,4-tricarboxylic acid, 1-hydroxyehtylidene-1,1-diphosphonic acid, N,N'-bis(2-hydroxybenzyl)ethylenediamine-N,N'-diacetic acid.

These chelating agents can be used as a mixture of two or more, if desired.

The amount of the chelating agent to be added to the color developer should be sufficient to sequester the metal ions in the color developer. For instance, the amount is from approximately 0.1 g/liter to approximately 10 g/liter.

The color developer for use in the present invention may contain a development accelerator, if desired.

Examples of appropriate development accelerators include thioether compounds described in JP-B-37-16088, 37-5987, 38-7826, 44-12380, 45-9019 and U.S. Pat. No. 3,813,417; p-phenylenediamine compounds described in JP-A-52-49829 and 50-15554; quaternary ammonium salts described in JP-A-50-137726, JP-B-44-30074, JP-A-56-156826 and 52-43429; amine compounds described in U.S. Pat. Nos. 2,494,903, 3,128,182, 4,230,796, 3,253,919, JP-B 41-11431, U.S. Pat. Nos. 2,482,546, 2,596,926 and 3,582,346; polyalkylene oxides described in JP-B-37-16088, 42-25201, U.S. Pat. No. 3,128,183, JP-B-41-11431, 42-23883 and U.S. Pat. No. 3,532,501; as well as other 1-phenyl-3-pyrazolidones and imidazoles.

The color developer for us in the present invention can contain an antifoggant, if desired. For instance, alkali metal halides such as sodium chloride, potassium bromide or potassium iodide, as well as organic antifoggants, can be used. Examples of appropriate organic antifoggants, nitrogen-containing heterocyclic compounds are typical. They include benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethyl-benzimidazole, indazole, hydroxyazaindolidine and adenine.

The color developer for use in the present invention preferably contains a brightening agent. As that agent, 4,4'-diamino-2,2'-disulfostilbene compounds are preferred. The amount of the agent to be added to the color developer is up to 5 g/liter, preferably from 0.1 g/liter to 4 g/liter.

If desired, the color developer for use in the present invention may further contain also various surfactants such as alkylsulfonic acids, arylsulfonic acids, aliphatic carboxylic acids and aromatic carboxylic acids.

The processing temperature for the color developer in accordance with the present invention is from 20° to 50° C., preferably from 30° to 40° C. The processing time therewith is from 20 seconds to 5 minutes, preferably from 30 seconds to 2 minutes. The amount of the replenisher to be added to the process for the color developer is preferably smaller. For instance, it is suitably from 20 to 600 ml, preferably from 50 to 300 ml, per $m^2$ of the photographic material being processed. More preferably, the amount of the replenisher is from 60 ml to 200 ml, most preferably from 60 to 150 ml, per $m^2$ of the material.

Next, the desilvering step to be applied to the present invention will be explained. As the desilvering system may comprise; bleaching and fixation; fixation and bleach-fixation; bleaching and bleach-fixation; and bleach-fixation.

The bleaching solution, bleach-fixing solution and fixing solution which can be employed in the present invention are explained below.

Any and every bleaching agent can be used in the bleaching solution or bleach-fixing solution. Especially preferred as the bleaching agent are organic complexes of iron(III) (for example, iron(III) complexes with aminoplycarboxylic acids such as ethylenediaminetetraacetic acid or diethylenetriamine-pentaacetic acid, or with aminopolyphosphonic acids, phosphonocarboxylic acids or organic phosphonic acids); organic acids such as citric acid, tartaric acid or malic acid; persulfates; and hydrogen peroxide.

Among them, organic complexes of iron(III) are most preferred, since they are suitable for rapid processing and do not contribute to environmental pollution. Examples of aminopolycarboxylic acids, aminopolyphosphonic acids, organic phosphonic acids and salts thereof which are useful for forming organic complexes of iron(III), include ethylenediaminetetraacetic acid, diethylenetriamine-pentaacetic acid, 1,3-diaminopropanetetraacetic acid, -propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of sodium, potassium, lithium or ammonium salts thereof. Among them, iron(III) complexes of ethylenediaminetetraacetic acid, diethylenetriaminepentaacetic acid, cyclohexanediaminetetraacetic acid, 1,3-diaminopropanetetraacetic acid and methyliminodiacetic acid are preferred, as having a high bleaching capacity.

The ferric complex may be directly added to the solution as the complex itself; or alternatively, a ferric salt such as ferric sulfate, ferric chloride, ferric nitrate, ammonium ferric sulfate or ferric phosphate may be added to the solution together with a chelating agent such as an aminopolycarboxylic acid, aminopolyphosphonic acid or phosphonocarboxylic acid, with the ferric complex forming in the solution. The amount of the chelating agent may exceed the necessary amount for forming the intended ferric complex. Among ferric complexes, aminopolycarboxylato/ferric complexes are preferred. The amount thereof to be added to the solution is from 0.01 to 1.0 mol/liter, more preferably from 0.05 to 0.50 mol/liter.

The bleaching solution, the bleach-fixing solution and/or the previous bath thereof may contain compounds as a bleaching accelerator. For instance; mercapto group- or disulfido bond-containing compounds described in U.S. Pat. No. 3,893,858, German Patent 1,290,812,.JP-A-53-95630 and *Research Disclosure,* Item No. 17129 (July, 1978); thiourea compounds described in JP-B-45-8506, JP-A-52-20832, 53-32735 and U.S. Pat. No. 3,706,561; and halides such as iodides or bromides are preferred as the bleaching accelerator, because they have an excellent bleaching-accelerating capacity.

In addition, the bleaching solution or bleach-fixing solution employed in the present invention may further contain a re-halogenating agent such as bromides (for example, potassium bromide, sodium bromide, ammonium bromide), chlorides (for example, potassium chloride, sodium chloride, ammonium chloride) or iodides (for example, ammonium iodide). If desired, the solution may contain also one or more inorganic acids or organic acids or alkali metal or ammonium salts thereof which have a pH-buffering capacity, such as borax, sodium metaborate, acetic acid, sodium acetate, sodium carbonate, potassium carbonate, phosphorus acid, phosphoric acid, sodium phosphate, citric acid, sodium citrate or tartaric acid, as well as an antiseptic such as ammonium nitrate or guanidine.

A known fixing agent can be employed in the bleach-fixing solution or fixing solution for use in the present invention. The fixing agent may be one or more water-soluble silver halide solubilizers which include, for example, thiosulfates such as sodium thiosulfate or ammonium thiosulfate; thiocyanates such as sodium thiocyanate or ammonium thiocyanate; thioether compounds such as ethylenebisthioglycolic acid or 3,6-dithia-1,8-octanediol; and thioureas. A particular bleach-fixing solution containing the fixing agent described in JP-A-55-155354 together with a large amount of a halide such as potassium iodide can also be used. In the present invention, thiosulfates, especially ammonium thiosulfate, are preferably used. The amount of the fixing agent in the solution is preferably from 0.3 to 2 mol/liter, more preferably from 0.5 to 1.0 mol/liter. The pH range of the bleach-fixing solution or fixing solution for use in the present invention is preferably from 3 to 10, more preferably from to 9.

The bleach-fixing solution may also contain other various brightening agents, defoaming agents or surfactants as well as organic solvents such as polyvinyl pyrrolidone or methanol.

The bleach-fixing solution or fixing solution contains, as a preservative, sulfite ion-releasing compounds such as sulfites (e.g., sodium sulfite, potassium sulfite, ammonium sulfite) bisulfites (e.g., ammonium bisulfite, sodium bisulfite, potassium bisulfite), metabisulfites (e.g., potassium metabisulfite, sodium metabisulfite, ammonium metabisulfite). This compound is preferably incorporated into the solution in an amount of approximately from 0.02 to 0.50 mol/liter, more preferably approximately from 0.04 to 0.40 mol/liter, as the sulfite ion.

As the preservative, addition of sulfites is common, but other ascorbic acid, carbonyl-bisulfite adducts or carbonyl compounds may also be added to the solution.

In addition, the solution may also contain a buffer, a brightening agent, a chelating agent, a defoaming agent and a fungicide, if desired.

After desilvered by fixation or bleach-fixation, the photographic material is generally rinsed in water and/or stabilized.

The amount of water to be used in the rinsing step varies, depending upon the characteristics of the photographic material being processed (for example, the constituent elements such as couplers and others), the use of the material, the temperature of the rinsing water, the number of the rinsing bathes (the number of rinsing stages), whether the replenishment system is by normal current or countercurrent, and other conditions. The appropriate amount of water is defined in a broad range. For instance, the relation between the number of the rinsing tanks and the amount of the rinsing water in a multi-stage countercurrent rinsing system may be obtained by the method described in *Journal of the Society of Motion Picture and Television Engineering*, Vol. 64, pages 248 to 253 (May, 1955). In general, the number of stages in a multi-stage countercurrent rinsing system is preferably from 2 to 6, especially preferably from 2 to 4.

In accordance with the multi-stage countercurrent rinsing system, the amount of rinsing water to be used may be noticeably reduced. For example, the amount may be from 0.5 liter to one liter, or less, per $m^2$ of the photographic material being processed. Accordingly, the effect of the present invention is remarkable when the rinsing is effected by such system. However, the system has the problem that bacteria may propagate in the rinsing tanks because of the increased residence time of the rinsing water in the tanks, so that the floating substances formed may adhere to the photographic material being processed. As a means of overcoming this problem, the method of reducing calcium and magnesium in the water, described in JP-A-62-288838, can be employed extremely efficiently. In addition, isothiazolone compounds or thiabendazoles described in JP-A-57-8542; chlorine-containing microbicides such as sodium chloroisocyanurates described in JP-A-61-120145; benzotriazoles described in JP-A-61-267761; copper ions; as well as other microbicides described in H. Horiguchi, *Antibacterial and Antifungal Chemistry* (published by Sankyo Publishing Co., Japan, 1986), *Bactericidal and Fungicidal Techniques to Microorganisms* (edited by Association of Sanitary Technique and published by Association of Industrial Technique, Japan, 1982) and *Encyclopedia of Bactericidal and Fungicidal Agents* (edited by Nippon Bactericide and Fungicide Association, Japan, 1986), can also be used to overcome this problem.

In addition, the rinsing water may also contain a surfactant as a water-cutting agent, as well as a chelating agent such as EDTA as a water softener.

Following the above-mentioned rinsing step or in the absence of that step, the material may be stabilized. The stabilizing solution to be used in the stabilizing step may contain a compound having the function of stabilizing the image formed. For instance, such compounds include an aldehyde the film pH value to one suitable for stabilizing the dye formed, and an ammonium compound. In addition, the above-mentioned fungicides and bactericides may be added to the stabilizing solution for the purpose of preventing propagation of bacteria or fungi in the solution or for the purpose of imparting a fungicidal property to be processed.

The solution may also contain a surfactant, a brightening agent and a hardening agent. When the photographic material of the present invention is directly stabilized without the water-rinsing step, all the known methods, for example, described in JP-A-57-8543, 58-14834 and 60-220345 can be employed.

Another preferred embodiment of the stabilization step comprises the use of chelating agents such as 1-hydroxyethylidene-1,1-diphosphonic acid or ethylenediaminetetramethylenephosphonic acid as well as magnesium or bismuth compounds.

A so-called rinsing solution may be employed as the water-rinsing solution or stabilizing solution in the step to be effected after the desilvering step.

The pH value in the water-rinsing step or stabilizing step is preferably from 4 to 10, more preferably from 5 to 8. The temperature in the step may be determined in accordance with the use and characteristics of the photographic material being processed. In general, it may be 15° C. to 45° C., preferably 20° C. to 40° C. The processing time in the step may be determined freely. But it is preferably short, since the total processing time should be reduced. Preferably, the time for the water-rinsing or stabilizing step is from 15 seconds to 1 minute and 45 seconds, more preferably from 30 seconds to 1 minute and 30 seconds. The amount of the replenisher to be added to the step is preferably small, to reduce running cost, to reduce the drainage amount and to ease handling.

The following examples are intended to illustrate the present invention in more detail, but not to limit it in any way.

Unless otherwise indicated, all parts, percents, ratios and the like are by weight.

EXAMPLE 1

Sodium chloride in the amount of 6.4 g was added to an aqueous 3% solution of lime-processed gelatin, and 3.2 ml of N,N'-dimethylimidazolidine-2-thione (aqueous 1% solution) was added thereto. To the resulting solution were added an aqueous solution containing 0.2 mol of silver nitrate and a aqueous solution containing 0.08 mol of potassium bromide and 0.12 mol of sodium chloride. The mixture was vigorously stirred at 52° C. and blended. Subsequently, an aqueous solution containing 0.8 mol of silver nitrate and an aqueous solution containing 0.32 mol of potassium bromide, 0.48 mol of sodium chloride and 50 μg of potassium hexachloroiridate(IV) were added thereto also with vigorously stirring at 52° C. to blend the materials.

After the whole was kept at 52° C. for 5 minutes, it was desalted and rinsed with water. Then, 90.0 g of lime-processed gelatin was added thereto. The pH and pAg values of the thus obtained emulsion were adjusted, and $4\times10^{-5}$ mol of spectral sensitizing dye (I-6) was added to the emulsion at 54° C. Next, $2.6\times10^{-5}$ mol of triethylthiourea was added thereto and ripened. After the ripening, 250 mg of the above-mentioned compound (II-1) was added to the emulsion. The silver chlorobromide emulsion thus spectrally sensitized and chemical-sensitized, containing cubic grains having a mean grain size of 0.52 micron and having a silver bromide content of 40 mol%), was called Emulsion No. 101.

Next, 3.3 g of sodium chloride was added to an aqueous 3% solution of lime-processed gelatin, and 3.2 ml of N,N'-dimethylimidazolidine-2-thione (aqueous 1% solution) was added thereto. To the solution were added an aqueous solution containing 0.2 mol of silver nitrate and an aqueous solution containing 0.2 mol of sodium chloride. The mixture was vigorously stirred at 52° C., and blended. Subsequently, an aqueous solution containing 0.8 mol of silver nitrate and an aqueous solution containing 0.8 mol of sodium chloride and 2.0 mg of potassium hexacyanoferrite(II) trihydrate were added thereto also with vigorous stirring at 52° C., to blend the mixture. After the whole was kept at 52° C. for 5 minutes, it was desalted and rinsed with water. Then, 90.0 g of lime-processed gelatin was added thereto. The pH and pAg values of the thus obtained emulsion were adjusted, and $4\times10^{-5}$ mol of spectral sensitizing dye (I-6) was added to the emulsion at 54° C. Next, fine silver bromide grains (having a grain size of 0.05 micron and containing potassium hexachloroiridate(IV) in an amount of 80 mg per mol of silver bromide) were added thereto in an amount corresponding to 2 mol%. Then, $1.6\times10^{-5}$ mol of triethylthiourea was added to the emulsion and ripened. After the ripening, 120 mg of the above-mentioned compound (III-2) was added to the emulsion. The silver chlorobromide emulsion thus spectrally sensitized and chemical-sensitized, containing cubic grains having a mean grain size of 0.54 micron and having a silver bromide content of 2 mol%), was called Emulsion No. 102.

Emulsion No. 103 was prepared in the same manner as Emulsion No. 102, except that $5\times10^{-5}$ mol of spectral sensitizing dye (I-36) was further added simultaneously with addition of spectral sensitizing dye (I-6).

Emulsion No. 104 was prepared in the same manner as Emulsion No. 102, except that $3\times10^{-5}$ mol of spectral sensitizing dye (I-41) was further added simultaneously with addition of spectral sensitizing dye (I-6).

Emulsion No. 105 and Emulsion No. 106 were prepared in the same manner as Emulsion No. 103 and Emulsion No. 104, respectively, except that the time for adding spectral sensitizing dyes (I-36) and (I-41) was deferred until after the rinsing step. Precisely, in preparing Nos. 105 and 106, the dyes were added 10 minutes before addition of compound (III-2).

Emulsion No. 107 and Emulsion No. 108 were prepared in the same manner as Emulsion No. 105 and Emulsion No. 106, respectively, except that 180 mg of nucleic acid was added 5 minutes before addition of spectral sensitizing dyes (I-36) and (I-41).

Emulsion No. 109 and Emulsion No. 110 were prepared in the same manner as Emulsion No. 107 and Emulsion No. 108, respectively, except that 180 mg of nucleic acid was replaced by 18 g of the above-mentioned compound (II-1).

Emulsion No. 111 and Emulsion No. 112 were prepared in the same manner as Emulsion No. 107 and Emulsion No. 108, respectively, except that 180 mg of nucleic acid was replaced by 16 g of the above-mentioned compound (II-11).

Characteristics of these emulsions were summarized in the following Table 1.

TABLE 1

| Emulsion | Halogen Composition* | Red-Sensitizing Dye | Blue-Sensitizing Dye (Addition Time) | Green-Sensitizing Dye (Addition Time) | N-containing Heterocyclic Compound Added prior to Addition of Blue-/Green-Sensitizing Dye | Remarks |
|---|---|---|---|---|---|---|
| 101 | $AgBr_{0.4}Cl_{0.6}$ | I-6 | — | — | — | Comparison |
| 102 | $AgBr_{0.02}Cl_{0.98}$ | I-6 | — | — | — | Comparison |
| 103 | $AgBr_{0.02}Cl_{0.98}$ | I-6 | I-36 (together with I-6) | — | — | Comparison |
| 104 | $AgBr_{0.02}Cl_{0.98}$ | I-6 | — | I-41 (together with I-6) | — | Comparison |
| 105 | $AgBr_{0.02}Cl_{0.98}$ | I-6 | I-36 | — | — | Invention |

TABLE 1-continued

| Emulsion | Halogen Composition* | Red-Sensitizing Dye | Blue-Sensitizing Dye (Addition Time) | Green-Sensitizing Dye (Addition Time) | N-containing Heterocyclic Compound Added prior to Addition of Blue-/Green-Sensitizing Dye | Remarks |
|---|---|---|---|---|---|---|
| | | | (After I-6) | | | |
| 106 | $AgBr_{0.02}Cl_{0.98}$ | I-6 | — | I-41 (After I-6) | — | Invention |
| 107 | $AgBr_{0.02}Cl_{0.98}$ | I-6 | I-36 (After I-6) | — | Nucleic Acid | Invention |
| 108 | $AgBr_{0.02}Cl_{0.98}$ | I-6 | — | I-41 (After I-6) | Nucleic Acid | Invention |
| 109 | $AgBr_{0.02}Cl_{0.98}$ | I-6 | I-36 (After I-6) | — | (II-1) | Invention |
| 110 | $AgBr_{0.02}Cl_{0.98}$ | I-6 | — | I-41 (After I-6) | (II-1) | Invention |
| 111 | $AgBr_{0.02}Cl_{0.98}$ | I-6 | I-36 (After I-6) | — | (II-11) | Invention |
| 112 | $AgBr_{0.02}Cl_{0.98}$ | I-6 | — | I-41 (After I-6) | (II-11) | Invention |

*Halogen composition is represented by mol ratio.

Next, 25.0 g of cyan coupler (a), 31.25 g of color image stabilizer (b), 14.06 g of color image stabilizer (c) and 3.91 g of color image stabilizer (d) were dissolved in 100 ml of ethyl acetate and 10.94 g of solvent (e). The resulting solution was dispersed in 500 ml of aqueous 10% gelatin solution containing 40 ml of 10% sodium dodecylbenzenesulfonate, by emulsification. The thus obtained emulsified dispersion was called Coupler Dispersion (C-1).

Each of the previously obtained silver halide emulsions was blended with the thus obtained Coupler Dispersion to prepare various coating compositions as shown in Table 2 below. Thirty minutes after preparation, the coating composition was coated on a paper support as a lamination with polyethylene on both surfaces thereof, along with a protective layer, the layer constitution being indicated in Table 3 below. In addition, a comparative coating composition was prepared by adding $1.2 \times 10^{-4}$ mol per mol of silver halide of blue-sensitizing dye (I-36) to Emulsion No. 102. A comparative coating composition was also prepared by adding $8.0 \times 10^{-5}$ mol per mol of silver halide of green-sensitizing dye (I-41) to Emulsion No. 102. These comparative compositions were coated on the support to prepare comparative samples. Next, the coating compositions were stored at 40° C. for 6 hours and then coated on the support in the same way as above. Using the samples thus prepared, the storage stability of the coating compositions was checked.

To each coating composition was added the following compound in an amount of $2.6 \times 10^{-3}$ mol per mol of silver halide.

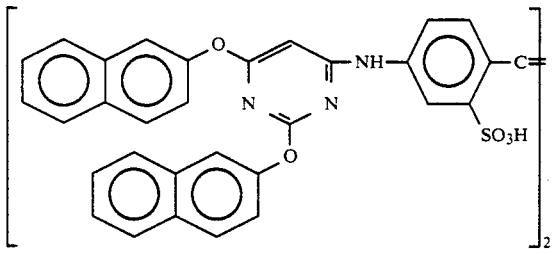

As a gelatin hardening agent, sodium 1-hydroxy-3,5-dichloro-s-triazine was added to each layer.

TABLE 2

| Sample | Emulsion Added to Coating Composition | Coupler Dispersion Added to Coating Composition | Spectral Sensitizing Dye Added to Coating Composition during Preparation of the Composition | Time from Preparation of Coating Composition to Coating of the Same | Remarks |
|---|---|---|---|---|---|
| 101 | 101 | C-1 | — | 30 minutes | Comparison |
| 102 | 102 | C-1 | — | 30 minutes | Comparison |
| 103 | 102 | C-1 | (I-36) | 30 minutes | Comparison |
| 104 | 102 | C-1 | (I-41) | 30 minutes | Comparison |
| 105 | 103 | C-1 | — | 30 minutes | Comparison |
| 106 | 104 | C-1 | — | 30 minutes | Comparison |
| 107 | 105 | C-1 | — | 30 minutes | Invention |
| 108 | 106 | C-1 | — | 30 minutes | Invention |
| 109 | 107 | C-1 | — | 30 minutes | Invention |
| 110 | 108 | C-1 | — | 30 minutes | Invention |
| 111 | 109 | C-1 | — | 30 minutes | Invention |
| 112 | 110 | C-1 | — | 30 minutes | Invention |
| 113 | 111 | C-1 | — | 30 minutes | Invention |
| 114 | 112 | C-1 | — | 30 minutes | Invention |
| 115 | 101 | C-1 | — | 6 hours | Comparison |
| 116 | 102 | C-1 | — | 6 hours | Comparison |
| 117 | 102 | C-1 | (I-36) | 6 hours | Comparison |
| 118 | 102 | C-1 | (I-41) | 6 hours | Comparison |
| 119 | 103 | C-1 | — | 6 hours | Comparison |
| 120 | 104 | C-1 | — | 6 hours | Comparison |
| 121 | 105 | C-1 | — | 6 hours | Invention |
| 122 | 106 | C-1 | — | 6 hours | Invention |
| 123 | 107 | C-1 | — | 6 hours | Invention |

TABLE 2-continued

| Sample | Emulsion Added to Coating Composition | Coupler Dispersion Added to Coating Composition | Spectral Sensitizing Dye Added to Coating Composition during Preparation of the Composition | Time from Preparation of Coating Composition to Coating of the Same | Remarks |
|---|---|---|---|---|---|
| 124 | 108 | C-1 | — | 6 hours | Invention |
| 125 | 109 | C-1 | — | 6 hours | Invention |
| 126 | 110 | C-1 | — | 6 hours | Invention |
| 127 | 111 | C-1 | — | 6 hours | Invention |
| 128 | 112 | C-1 | — | 6 hours | Invention |

TABLE 3

| Layer | Amount Coated ($g/m^2$) |
|---|---|
| 2nd Layer (Protective Layer) | |
| Gelatin | 1.50 |
| 1st Layer (Red-sensitive Layer) | |
| Silver Chlorobromide Emulsion (See Table 2) | 0.23 |
| Cyan Coupler (a) | 0.32 |
| Color Image Stabilizer | |
| (b) | 0.40 |
| (c) | 0.18 |
| (d) | 0.05 |
| Solvent (e) | 0.14 |
| Gelatin | 1.34 |
| Polyethylene-duplicated Paper Support | |

The compounds used above are as follows:

Cyan Coupler (a):

1/1 mixture (by mol) of

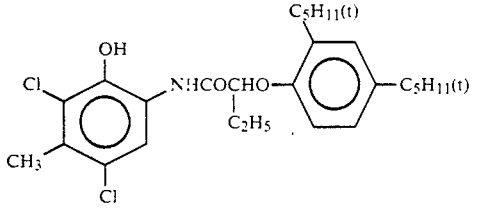

and

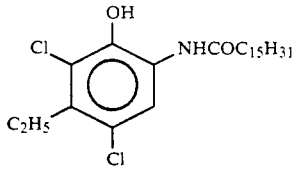

Color Image Stabilizer (b):

$\text{-}(CH_2\text{-}CH)_n\text{-}$
$\quad\quad |$
$\quad CONHC_4H_9(t)$ (mean molecular weight: 60,00)

Color Image Stabilizer (c):

2/4/4 mixture (by weight) of the following compounds:

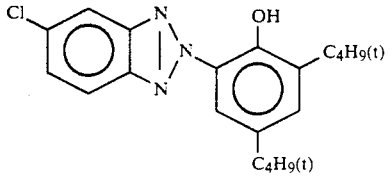

-continued

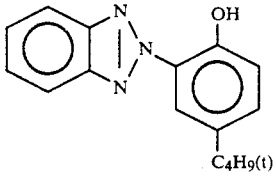

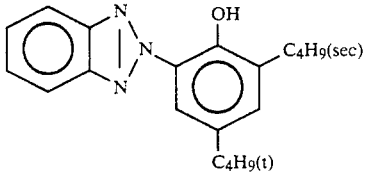

Color Image Stabilizer (d):

1/1 mixture (by weight) of

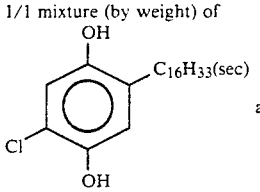

and

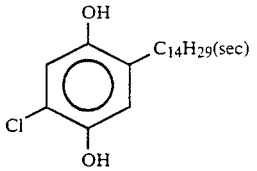

Solvent (e):

80/20 mixture (by volume) of

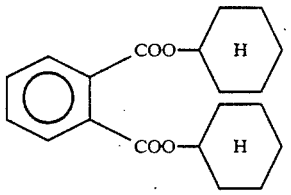

and $C_8H_{17}CH\underset{\underset{O}{\backslash\,/}}{CH}(CH_2)_7COOC_8H_{17}$

The 28 photographic material samples prepared in this manner were tested as follows.

Each sample was spectrally exposed with a spectral sensitometer and then processed with the processing solutions mentioned below in accordance with the processing procedure described below. The spectral sensitivity distribution of each of the thus processed samples was obtained.

Next, to obtain the photographic characteristic of each sample at each spectral wavelength, the samples were exposed (250 CMS, one second) to an optical wedge through red, green and blue filters. The exposed samples were processed for color development with the same processing solutions as above in accordance with the same processing procedure as above. For the thus processed samples, the reflection density of the colored area to each filter exposure was measured to obtain a so-called characteristic curve on the basis of the thus measured data. Since the samples had a sensitivity to the light falling within the wavelength range corresponding to the spectral sensitizing dye added, they displayed the intrinsic characteristic curves.

Specifically, samples Nos. 101 and 115 colored in the red-exposed area and the blue-exposed area and gave the corresponding characteristic curves;

Samples Nos. 102 and 116 colored only in the red-exposed area and gave the corresponding characteristic curves;

Samples Nos. 103 and 117 colored in the red-exposed area and the blue exposed area and gave the corresponding characteristic curves;

Samples Nos. 104 and 118 colored in the red-exposed area and the green-exposed area and gave the corresponding characteristic curves;

Samples Nos. 105 and 119 colored in the red-exposed area and the blue-exposed area and gave the corresponding characteristic curves;

Samples Nos. 106 and 120 colored in the red-exposed area and the green-exposed area and gave the corresponding characteristic curves;

Samples Nos. 107 and 121 colored in the red-exposed area and the blue-exposed area and gave the corresponding characteristic curves;

Samples Nos. 108 and 122 colored in the red-exposed area and the green-exposed area and gave the corresponding characteristic curves;

Samples Nos. 109 and 123 colored in the red-exposed area and the blue-exposed area and gave the corresponding characteristic curves;

Samples Nos. 110 and 124 colored in the red-exposed area and the green-exposed area and gave the corresponding characteristic curves;

Samples Nos. 111 and 125 colored in the red-exposed area and the blue-exposed area and gave the corresponding characteristic curves;

Samples Nos. 112 and 126 colored in the red-exposed area and the green-exposed area and gave the corresponding characteristic curves;

Samples Nos. 113 and 127 colored in the red-exposed area and the blue-exposed area and gave the corresponding characteristic curves; and Samples Nos. 114 and 128 colored in the red-exposed area and the green-exposed area and gave the corresponding characteristic curves.

From these characteristic curves were obtained relative sensitivity and gradation values. Specific. lly, the sensitivity value obtained was the reciprocal of the exposure amount giving a color density higher than the fog density of 0.5, and it was represented as the relative sensitivity on the basis of the standard mentioned below. Additionally, a logarithmic number of the exposure amount of giving the color density higher than the fog density of 0.2 and a logarithmic number of exposure amount of giving the color density higher of the fog density of 1.0 were obtained. The difference between the two numbers was represented as the index indicating the gradation.

Next, the coated samples were allowed to stand in an atmosphere of 40° C. and 80% RH for 5 days and were then subjected to the same sensitometry. The results obtained are shown in Table 4 below. These results demonstrate the fluctuation, if any, of the photographic properties of the samples after being stored for a long period of time.

| Processing Steps | Processing Steps | | | |
|---|---|---|---|---|
| Processing Steps | Temperature | Time | Replenisher (*) | Capacity of Tank |
| Color Development | 35° C. | 45 sec | 161 ml | 17 liters |
| Bleach-fixation | 30 to 35° C. | 45 sec | 215 ml | 17 liters |
| Rinsing (1) | 30 to 35° C. | 20 sec | — | 10 liters |
| Rinsing (2) | 30 to 35° C. | 20 sec | — | 10 liters |
| Rinsing (3) | 30 to 35° C. | 20 sec | 350 ml | 10 liters |
| Drying | 70 to 80° C. | 60 sec | | |

(*) Amount of replenisher is per $m^2$ of sample being processed.

(Rinsing was effected by three-tank countercurrent system from rinsing tank (3) to rinsing tank (1)).

However, since the development rate of Samples Nos. 101 and 115 was low, the time of color development was prolonged to 120 seconds for these samples.

The processing solutions used in the above-mentioned steps had the following compositions.

| Color Developing Solution | Tank Solution | Replenisher |
|---|---|---|
| Water | 800 ml | 800 ml |
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-ethyl-N-(β-methanesulfonamidoethyl)-3-methyl-4-aminoaniline Sulfate | 5.0 g | 7.0 g |
| N,N-bis(carboxymethyl)hydrazine | 4.0 g | 5.0 g |
| N,N-di(sulfoethyl)hydroxylamine/1Na | 4.0 g | 5.0 g |
| Brightening Agent (WHITEX 4B, product by Sumitomo Chemical Co.) | 1.0 g | 2.0 g |
| Water to make | 1000 ml | 1000 ml |
| pH (25° C.) | 10.05 | 10.45 |

| Bleach-fixing Solution: | |
|---|---|
| (Tank solution and replenisher were same.) | |
| Water | 400 ml |
| Ammonium Thiosulfate (700 g/l) | 100 ml |
| Sodium Sulfite | 17 g |
| Ammonium Ethylenediaminetetraacetato/Iron (III) | 55 g |
| Disodium Ethylenediaminetetraacetate | 5 g |
| Ammonium Bromide | 40 g |
| Water to make | 1000 ml |
| pH (25° C.) | 6.0 |

| Rinsing Solution: |
|---|
| (Tank solution and replenisher were same.) |
| Ion-exchanged Water (having calcium content of 3 ppm or less and magnesium content of 3 ppm or less). |

TABLE 4

| Sample | Peak of Spectral Sensitivity: Red Range (nm) | Green Range (nm) | Blue Range (nm) | Photographic Characteristics in in each spectral wavelength: Red Range Sensitivity | Red Range Gradation | Green Range Sensitivity | Green Range Gradation | Blue Range Sensitivity | Blue Range Gradation | photographic Characteristics after stored at 40° C. and 80% RH for 5 days: Red Range Sensitivity | Red Range Gradation | Green Range Sensitivity | Green Range Gradation | Blue Range Sensitivity | Blue Range Gradation | Remarks |
|---|---|---|---|---|---|---|---|---|---|---|---|---|---|---|---|---|
| 101 | 695 | — | 412 | 100 | 0.51 | — | — | 100 | 0.54 | 93 | 0.53 | — | — | 109 | 0.55 | Comparison |
| 102 | 698 | — | — | 139 | 0.34 | — | — | — | — | 130 | 0.34 | — | — | — | — | Comparison |
| 103 | 698 | — | 468 | 131 | 0.33 | — | — | 112 | 0.35 | 122 | 0.34 | — | — | 63 | 0.39 | Comparison |
| 104 | 698 | 518 | — | 130 | 0.35 | 100 | 0.36 | — | — | 121 | 0.36 | 58 | 0.41 | — | — | Comparison |
| 105 | 698 | — | 480 | 116 | 0.34 | — | — | 145 | 0.67 | 108 | 0.35 | — | — | 138 | 0.72 | Comparison |
| 106 | 698 | 551 | — | 115 | 0.33 | 151 | 0.64 | — | — | 107 | 0.34 | 143 | 0.70 | — | — | Comparison |
| 107 | 698 | — | 480 | 132 | 0.35 | — | — | 114 | 0.37 | 123 | 0.35 | — | — | 108 | 0.36 | Invention |
| 108 | 698 | 551 | — | 131 | 0.36 | 106 | 0.37 | — | — | 122 | 0.36 | 99 | 0.37 | — | — | Invention |
| 109 | 698 | — | 479 | 129 | 0.32 | — | — | 111 | 0.34 | 120 | 0.33 | — | — | 105 | 0.33 | Invention |
| 110 | 698 | 550 | — | 128 | 0.33 | 102 | 0.34 | — | — | 119 | 0.32 | 98 | 0.32 | — | — | Invention |
| 111 | 698 | — | 479 | 133 | 0.31 | — | — | 110 | 0.32 | 124 | 0.31 | — | — | 105 | 0.33 | Invention |
| 112 | 698 | 550 | — | 132 | 0.31 | 99 | 0.32 | — | — | 123 | 0.32 | 96 | 0.33 | — | — | Invention |
| 113 | 698 | — | 479 | 134 | 0.28 | — | — | 110 | 0.30 | 125 | 0.28 | — | — | 107 | 0.29 | Invention |
| 114 | 698 | 550 | — | 133 | 0.27 | 98 | 0.29 | — | — | 124 | 0.28 | 96 | 0.28 | — | — | Invention |
| 115 | 695 | — | 412 | 95 | 0.52 | — | — | 103 | 0.55 | 89 | 0.54 | — | — | 112 | 0.56 | Comparison |
| 116 | 698 | — | — | 130 | 0.35 | — | — | — | — | 121 | 0.36 | — | — | — | — | Comparison |
| 117 | 698 | — | 474 | 119 | 0.35 | — | — | 123 | 0.36 | 111 | 0.36 | — | — | 73 | 0.38 | Comparison |
| 118 | 698 | 526 | — | 117 | 0.36 | 114 | 0.37 | — | — | 109 | 0.37 | 71 | 0.38 | — | — | Comparison |
| 119 | 698 | — | 481 | 110 | 0.35 | — | — | 138 | 0.71 | 103 | 0.36 | — | — | 133 | 0.75 | Comparison |
| 120 | 698 | 552 | — | 108 | 0.34 | 144 | 0.67 | — | — | 101 | 0.35 | 139 | 0.73 | — | — | Comparison |
| 121 | 698 | — | 480 | 127 | 0.36 | — | — | 111 | 0.37 | 119 | 0.37 | — | — | 106 | 0.37 | Invention |
| 122 | 698 | 551 | — | 125 | 0.37 | 102 | 0.37 | — | — | 117 | 0.38 | 96 | 0.38 | — | — | Invention |
| 123 | 698 | — | 479 | 23 | 0.33 | — | — | 108 | 0.34 | 115 | 0.33 | — | — | 103 | 0.35 | Invention |
| 124 | 698 | 550 | — | 122 | 0.34 | 99 | 0.34 | — | — | 114 | 0.33 | 95 | 0.33 | — | — | Invention |
| 125 | 698 | — | 479 | 128 | 0.32 | — | — | 107 | 0.32 | 119 | 0.31 | — | — | 102 | 0.33 | Invention |
| 126 | 698 | 550 | — | 127 | 0.31 | 97 | 0.32 | — | — | 119 | 0.32 | 95 | 0.33 | — | — | Invention |
| 127 | 698 | — | 479 | 129 | 0.28 | — | — | 108 | 0.29 | 120 | 0.28 | — | — | 106 | 0.30 | Invention |
| 128 | 698 | 550 | — | 128 | 0.28 | 97 | 0.28 | — | — | 119 | 0.29 | 96 | 0.28 | — | — | Invention |

(*) Regarding the relative sensitivity, the sensitivity to the red light range of the fresh Sample No. 101 was standardized to be 100, and the sensitivity thereof of the other sample was represented by the relative value based on the standard value 100 of No. 101; the sensitivity to the green light range of the fresh Sample No. 104 was standardized to be 100, and the sensitivity thereto of the other sample was represented by the relative value based on the standard value 100 of No. 104;

and the sensitivity to the blue light range of the fresh Sample No. 101 was standardized to be 100, and the sensitivity thereto of the other sample was represented by the relative value based on the standard value 100 of no. 101.

As is obvious from the results shown in Table 4 above, the Sample No. 101 and Sample No. 115 each containing a silver halide emulsion having a low silver chloride content were far inferior to other samples having a high silver chloride emulsion with respect to the color contrast, even though the color development time was prolonged to 120 seconds in the case of Sample Nos. 101 and 115. On the other hand, when a high silver chloride emulsion suitable for rapid processing is used, the sensitivity which is intrinsic to the emulsion in the visible light range is lost.

In order to compensate for that loss, the addition of blue-sensitizing dye or green-sensitizing dye, to the layer in the step of preparing the coating composition is ineffective. First, the reason for this is obvious from a comparison of Samples Nos. 103 and 104 prepared by coating the coating composition in 30 minutes after preparation of the composition with Samples Nos. 117 and 118 prepared by coating the coating composition in 6 hours after preparation of the composition. Specifically, when the spectral sensitizing dye was added to the coating composition during the step of preparing the composition, the sensitivity and the maximum wavelength (peak) of the spectral sensitivity distribution in the coating composition varied with the lapse of time. Second, when the samples were stored at 40° C. and 80% RH, the photographic properties thereof noticeably varied as compared with those of the corresponding fresh samples. In particular, the sensitivity of the stored samples was far lower than that of the fresh samples. On the other hand, when the spectral sensitizing dye was added simultaneously with addition of a red-sensitizing dye, the gradation of the samples to the blue light range and green light range was soft though the fluctuation of the photographic property was relatively small between the fresh samples and the stored samples. (Samples Nos. 119 and 120 were compared with Samples Nos. 105 and 106.) Therefore, these samples are unfavorable.

On the other hand, when the sensitizing dye for the blue light range or green light range is added to the emulsion after the sensitizing dye for the red light range in accordance with the technique of the present invention (refer to Samples Nos. 107 and 108; Samples Nos. 121 and 122), the samples had a hard gradation in the blue light range and in the green light range. Additionally, these samples were free from fluctuation of photographic properties even though the coating compositions were stored for a long period of time before coating or the coated samples were stored for a long period of time before being exposed and processed. The photographic properties of the samples of the present invention are stable. Further, when a nitrogen-containing heterocyclic compound was added prior to addition of the spectral sensitizing dye sensitive for blue light or green light (refer to Samples Nos. 109 to 114 and Samples Nos. 123to 128), even more favorable results were obtained.

EXAMPLE 2

Sodium chloride in the amount of 4.8 g was added to aqueous 3% solution of lime-processed gelatin, and 4.0 ml of N,N'-dimethylimidazolidine-2-thione (aqueous 1% solution) was added thereto. To the resulting solution were added an aqueous solution containing 0.2 mol of silver nitrate and an aqueous solution containing 0.2 mol of sodium chloride. The mixture was vigorously stirred at 66° C. and blended. Subsequently, an aqueous solution containing 0.8 mol of silver nitrate and an aqueous solution containing 0.8 mol of sodium chloride and 0.8 mg of potassium hexacyanoferrite(II) trihydrate were added thereto, also with vigorously stirring at 66° C. and blending. After the whole was kept at 66° C. for 5 minutes, it was desalted and rinsed with water. Then, 90.0 g of lime-processed gelatin was further added thereto. The pH and pAg value of the thus obtained emulsion were adjusted, and $3\times10^{-4}$ mol of spectral sensitizing dye (I-36) was added to the emulsion at 66° C. Next, after fine silver bromide grains (having a grain size of 0.05 micron and containing potassium hexachloroiridate(IV) in an amount of 40 mg per mol of silver bromide) were added to the emulsion in an amount corresponding to 1 mol%, $0.9\times10^{-5}$ mol of triethylthiourea was added thereto and ripened. At the end of the ripening, 80 mg of the above-mentioned compound (III-2) was added to the emulsion. The silver chlorobromide emulsion thus spectrally sensitized and chemical-sensitized, containing cubic grains having a mean grain size of 0.98 micron and having a silver bromide content of 2 mol%) was called Emulsion (B).

Next, 3.3 g of sodium chloride was added to aqueous 3 solution of lime-processed gelatin, and 2.8 ml of N,N'-dimethylimidazolidine-2-thione (aqueous 1% solution) was added thereto. To the solution were added an aqueous solution containing 0.2 mol of silver nitrate and an aqueous solution containing 0.2 mol of sodium chloride. The mixture was vigorously stirred at 50° C. and blended. Subsequently, an aqueous solution containing 0.8 mol of silver nitrate and an aqueous solution containing 0.8 mol of sodium chloride and 2.2 mg of potassium hexacyanoferrite(II) trihydrate were added thereto also with vigorously stirring at 50° C. and blending. After the whole was kept at 50° C. for 5 minutes, it was desalted and rinsed with water. Then, 90.0 g of lime-processed gelatin was further added thereto. The pH and pAg value of the thus obtained emulsion were adjusted, and $4\times10^{-4}$ mol of color sensitizing dye (I-41) was added to the emulsion at 54° C. Next, fine silver bromide grains (having grain size of 0.05 micron and containing potassium hexachloroiridate(IV) in an amount of 80 mg per mol of silver bromide) were added thereto in an amount corresponding to 2 mol%. Then, $1.8\times10^{-5}$ mol of triethylthiourea was added to the emulsion and ripened. At the end of the ripening, 120 mg of the above-mentioned compound (III-2) was added to the emulsion. The silver chlorobromide emulsion thus spectrally sensitized and chemical-sensitized, containing cubic grains having a mean grain size of 0.48 micron and having a silver bromide content of 2 mol%) was called Emulsion (C).

The thus obtained emulsions and the emulsions prepared in Example 1 were used. Various color photographic material samples of 14 types, having the composition, layer constitution and emulsion combination indicated below, were prepared. Preparation of the coating compositions used for forming the samples was conducted as mentioned below.

Preparation of First Layer-Coating Composition

Ethyl acetate in the amount of 27.2 ml and 7.9 ml of solvent (h) were added to 19.1 g of yellow coupler (f), 4.4 g of color image stabilizer (g) and 0.7 g of color image stabilizer and dissolved. The resulting solution was dispersed in 200 ml of aqueous 10% gelatin solution containing 8.0 ml of 10% sodium dodecylbenenesulfonate, by emulsification.

The thus prepared emulsified dispersion of coupler and the previously prepared .silver halide emulsion (B) were blended to form a coating composition for forming the first layer which had the composition as shown below.

The other coating compositions for the second layer to the seventh layer were also prepared in the same manner as above, except that the coating composition for the fifth layer was prepared from the same coating composition as that used in Samples Nos. 101 to 114 in Example 1. As the gelatin-hardening agent in each layer, the same one as that used in Example 1 was used.

For anti-irradiation, the following dyes (1) to (4) were added to the emulsion layer, the amount in the parentheses being the content of the dye in the layer. Dye (1) were added to the second layer and dyes (2) to (4) were added to the sixth layer shown below.

1.

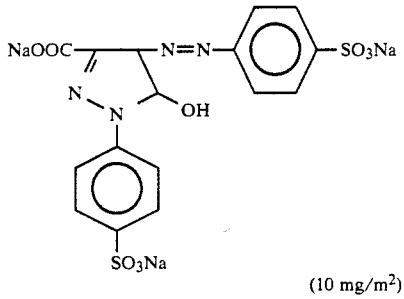

(10 mg/m²)

2.

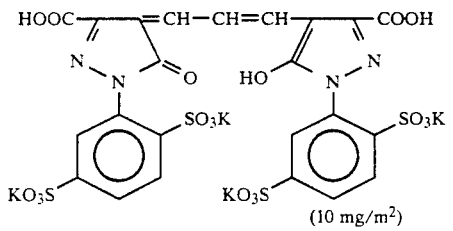

(10 mg/m²)

3.

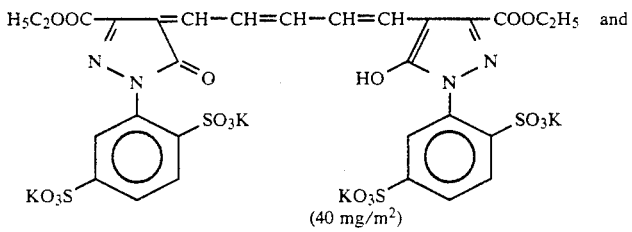

(40 mg/m²)

4.

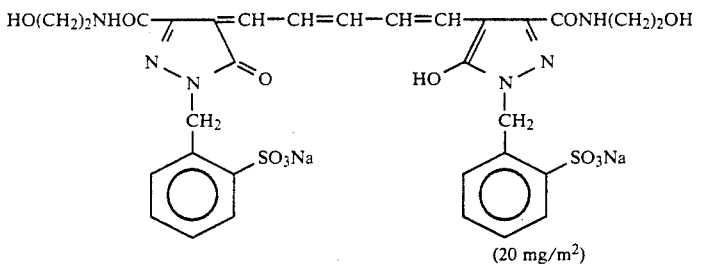

(20 mg/m²)

The constitution of the various layers of photographic samples was as follows:

| | |
|---|---|
| Support: | |
| Polyethylene-laminated Paper (containing TiO2 and ultramarine in the polyethylene layer located to the first layer side) | |
| First Layer: | |
| Silver Halide Emulsion (B) | 0.30 g/m² |
| Gelatin | 1.86 g/m² |
| Yellow Coupler (f) | 0.82 g/m² |
| Color Image Stabilizer (g) | 0.19 g/m² |
| Color Image Stabilizer (b) | 0.06 g/m² |
| Solvent (h) | 0.35 g/m² |
| Second Layer (Color Mixing Preventing Layer): | |
| Gelatin | 0.99 g/m² |
| Color Mixing Preventing Agent (i) | 0.08 g/m² |
| Solvent (h) | 0.16 g/m² |

-continued

| | |
|---|---|
| Solvent (j) | 0.08 g/m$^2$ |
| Third Layer (Green-sensitive Emulsion Layer): | |
| Silver halide Emulsion (C) | 0.12 g/m$^2$ |
| Gelatin | 1.24 g/m$^2$ |
| Magenta Coupler (k) | 0.20 g/m$^2$ |
| Color Image Stabilizer (l) | 0.03 g/m$^2$ |
| Color Image Stabilizer (m) | 0.15 g/m$^2$ |
| Color Image Stabilizer (n) | 0.02 g/m$^2$ |
| Color Image Stabilizer (o) | 0.02 g/m$^2$ |
| Solvent (p) | 0.40 g/m$^2$ |
| Fourth Layer (Ultraviolet Absorbing Layer): | |
| Gelatin | 1.58 g/m$^2$ |
| Ultraviolet Absorbent (q) | 0.47 g/m$^2$ |
| Color Mixing Preventing Agent (i) | 0.05 g/m$^2$ |
| Solvent (r) | 0.24 g/m$^2$ |
| Fifth Layer (Red-sensitive Emulsion Layer): | |
| Silver Halide Emulsion (see Table 5) | 0.23 g/m$^2$ |
| Gelatin | 1.34 g/m$^2$ |
| Cyan Coupler (a) | 0.32 g/m$^2$ |
| Color Image Stabilizer (b) | 0.40 g/m$^2$ |
| Color Image Stabilizer (c) | 0.18 g/m$^2$ |
| Color Image Stabilizer (d) | 0.05 g/m$^2$ |
| Solvent (e) | 0.14 g/m$^2$ |
| Sixth Layer (Ultraviolet Absorbing Layer): | |
| Gelatin | 0.53 g/m$^2$ |
| Ultraviolet Absorbent (q) | 0.16 g/m$^2$ |
| Solvent (r) | 0.08 g/m$^2$ |
| Seventh Layer (Protective Layer): | |
| Gelatin | 1.33 g/m$^2$ |
| Acryl-modified Polymer of Polyvinyl Alcohol (modification degree: 17%) | 0.17 g/m$^2$ |
| Liquid Paraffin | 0.03 g/m$^2$ |

Compounds used above are mentioned below.

Yellow Coupler (f):

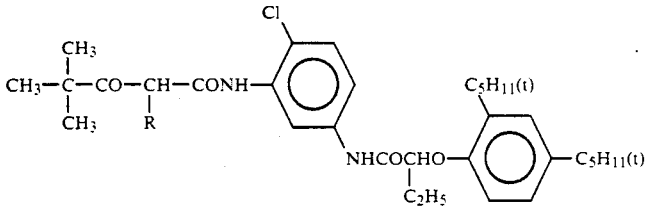

1/1 mixture (by mol) of

R =

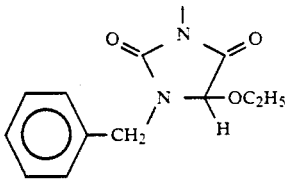

and

R =

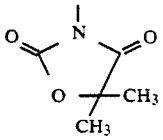

Color Image Stabilizer (g):

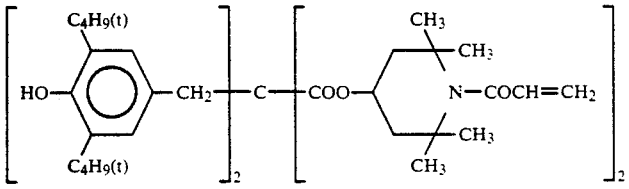

-continued
Solvent (h):
1/1 mixture (by volume) of
$O{=}P{+}O{-}C_9H_{19}(iso)]_3$
and
$C_8H_{17}CHCH(CH_2)_7COOC_8H_{17}$ (epoxide)
Color Mixing Preventing Agent (i):
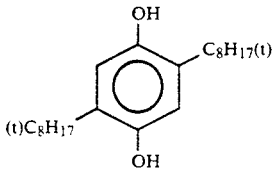
Solvent (j):
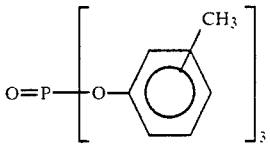
Magenta Coupler (k):
1/1 mixture (by mol) of
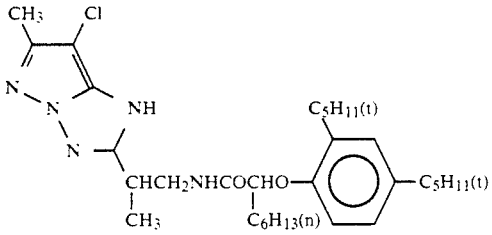
and
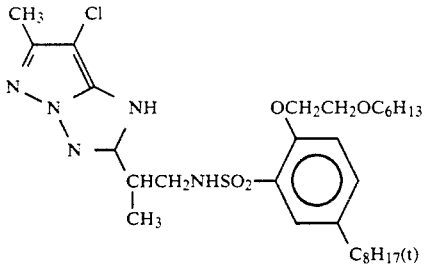
Color Image Stabilizer (l):
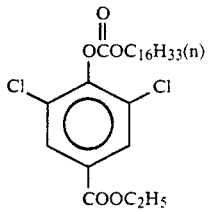
Color Image Stabilizer (m):

-continued
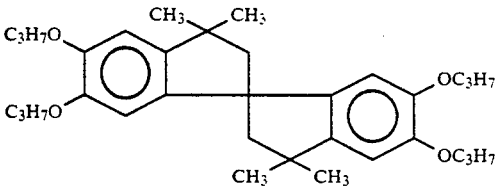
Color Image Stabilizer (n):
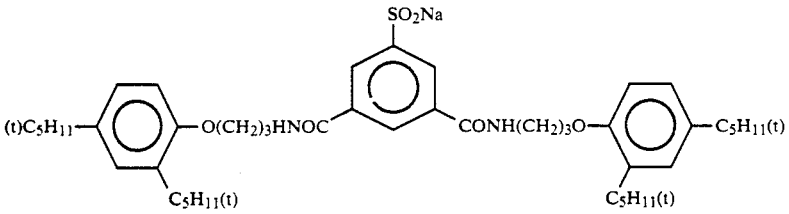
Color Image Stabilizer (o):
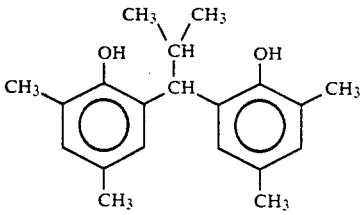
Solvent (p):
2/1 mixture (by volume) of
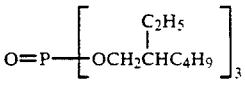
and
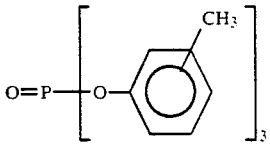
Ultraviolet Absorbent (q):
4/2/4 mixture (by weight) of the following compounds:
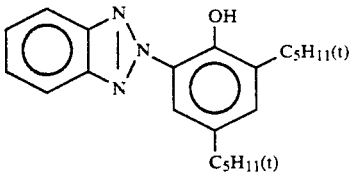
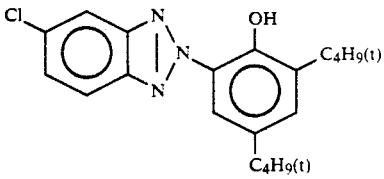

-continued

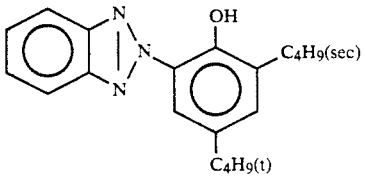

Solvent (r):

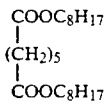

TABLE 5

| Sample | Coating Composition of 5th Layer |
|---|---|
| 201 | Same as Emulsion Layer in Sample 101 |
| 202 | Same as Emulsion Layer in Sample 102 |
| 203 | Same as Emulsion Layer in Sample 103 |
| 204 | Same as Emulsion Layer in Sample 104 |
| 205 | Same as Emulsion Layer in Sample 105 |
| 206 | Same as Emulsion Layer in Sample 106 |
| 207 | Same as Emulsion Layer in Sample 107 |
| 208 | Same as Emulsion Layer in Sample 108 |
| 209 | Same as Emulsion Layer in Sample 109 |
| 210 | Same as Emulsion Layer in Sample 110 |
| 211 | Same as Emulsion Layer in Sample 111 |
| 212 | Same as Emulsion Layer in Sample 112 |
| 213 | Same as Emulsion Layer in Sample 113 |
| 214 | Same as Emulsion Layer in Sample 114 |

The respective coated samples contained the following compounds in the amounts shown as in antiseptic.

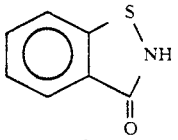

(25 mg/m$^2$)

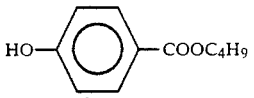

(50 mg/m$^2$)

Next, balls of yellow knitting yarn and balls of red knitting yarn (both are commercial products having an ordinary thickness) were prepared. They were photographed with a photographic film (Fuji Color Super HR100, commercial product by Fuji Photo Film Co., Ltd.) under an oblique downward lighting from the above. The exposed film was processed by the instructed process (Fuji's Development CN-16) to obtain a negative film. The negative film was printed on each of the previously prepared samples Nos. 201 to 214 by the use of a printer (Fuji 450 Model). Then, the samples were processed in the same manner as in Example 1 to obtain color prints. However, the color development time of developing the sample No. 201 was 120 seconds as in Example 1.

The thus obtained color prints were evaluated by a functional test of testing the color gradation reproducibility. Evaluation was effected on the basis of the following four ranks.

Rank 1 : The color purity was highly reproduced. The shadow of the yarn balls was also reproduced faithfully. The image obtained was not flat but had a three-dimensional appearance.

Rank 2 : Although the color purity was highly reproduced, reproduction of the shadow of the yarn balls was insufficient. The image obtained did not have a sufficiently three-dimensional appearance.

Rank 3 : Although the shadow of the yarn balls was faithfully reproduced, the image had a somewhat lowered color purity.

Rank 4 : Although the shadow of the yarn balls was faithfully reproduced, the image had a noticeably lowered color purity.

The results obtained are shown in Table 6 below.

TABLE 6

| Sample | Reproduction of Yarn Balls on Print: Yellow Yarn Balls | Red Yarn Balls | Remarks |
|---|---|---|---|
| 201 | Rank 4 | Rank 4 | Comparative Sample |
| 202 | Rank 2 | Rank 2 | Comparative Sample |
| 203 | Rank 1 | Rank 1 | Comparative Sample |
| 204 | Rank 2 | Rank 1 | Comparative Sample |
| 205 | Rank 3 | Rank 3 | Comparative Sample |
| 206 | Rank 2 | Rank 3 | Comparative Sample |
| 207 | Rank 1 | Rank 1 | Sample of the Invention |
| 208 | Rank 2 | Rank 1 | Sample of the Invention |
| 209 | Rank 1 | Rank 1 | Sample of the Invention |
| 210 | Rank 2 | Rank 1 | Sample of the Invention |
| 211 | Rank 1 | Rank 1 | Sample of the Invention |
| 212 | Rank 2 | Rank 1 | Sample of the Invention |
| 213 | Rank 1 | Rank 1 | Sample of the Invention |
| 214 | Rank 2 | Rank 1 | Sample of the Invention |

From the results in Table 6 above, it is noted that Sample No. 201, having a low silver chloride emulsion-containing red-sensitive layer, has an excellent capability of reproducing the shade of the yarn balls, but the image formed had a low color purity. Additionally, it is unsuitable for rapid processing. On the other hand, Sample No. 202 having a high silver chloride-containing red-sensitive layer was excellent in the rapid processability and reproducibility of pure colors, but the capability thereof for reproducing the shade of the yarn balls was insufficient. Therefore, the print obtained had an insufficient three-dimensional appearance. When the silver chloride emulsion in the red-sensitive layers in these samples was spectrally sensitized also in the blue light range or green light range, in addition to the red light range, improvement of the reproducibility of the shade of the yarn balls was possible. However, if the sensitizing dye for a blue light range or green light range was added to the coating composition during the step of preparing the composition, the fluctuation of the photographic property was great because of storage of the coating composition before coating and of storage of the coated sample, as with the results of Example 1. Therefore, stable preparation of photographic materials was impossible in that case. On the other hand, when the sensitizing dye for a red light range and the sensitizing dye sensitive for a blue light range or green light range are simultaneously added to the photographic emulsion, reproduction of a pure color is inhibited, as is obvious from the data of Samples Nos. 205 and 206. Therefore, simultaneous addition of the two dyes is unfavorable. Only the photographic material samples containing the emulsions of the present invention (Samples Nos. 207 to 214) gave satisfactory prints with faithful color gradation reproducibility without retarding the color purity in the printed image. From that viewpoint, when an emulsion having a spectral sensitivity in a blue light range is used, improvement of color gradation of both yellow color and red color is possible.

As is obvious from the results in the above-mentioned examples, the silver halide color photographic materials containing the particular emulsion prepared by the method of the present invention may be processed by rapid processing to give excellent color images with satisfactory tone reproducibility and color reproducibility. Additionally, the storage stability of the coating compositions during preparation of the materials as well as that of the prepared materials are good.

EXAMPLE 3

Emulsion No. 301 was prepared in the same manner as Emulsion No. 102, except that the time adding the red-sensitizing dye (I-6) was varied to the time immediately after the completion of the formation of the silver halide grains (precisely, 1 minute after the second addition of the aqueous solution of silver nitrate and the aqueous solution of sodium chloride), and then the mixture was kept at 52° C. for 10 minutes.

Emulsion No. 302 was prepared in the same manner as Emulsion No. 105, except that the time adding the red-sensitizing dye was varied to the time immediately after the completion of the formation of the silver halide grains (precisely, 1 minute after the second addition of the aqueous solution of silver nitrate and the aqueous solution of sodium chloride), and then the mixture was kept at 52° C. for 10 minutes.

Emulsion No. 303 was prepared in the same manner as Emulsion 106, except that the time adding the red-sensitizing dye was varied to the time immediately after the completion of the formation of the silver halide grains (precisely, 1 minute after the second addition of the aqueous solution of silver nitrate and the aqueous solution of sodium chloride), and then the mixture was kept at 52° C. for 10 minutes.

Emulsion No. 304 was prepared in the same manner as Emulsion 111, except that the time adding the red-sensitizing dye was varied to the time immediately after the completion of the formation of the silver halide grains (precisely, 1 minute after the second addition of the aqueous solution of silver nitrate and the aqueous solution of sodium chloride), and then the mixture was kept at 52° C. for 10 minutes.

Emulsion No. 305 was prepared in the same manner as Emulsion 112, except that the time adding the red-sensitizing dye was varied to the time immediately after the completion of the formation of the silver halide grains (precisely, 1 minute after the second addition of the aqueous solution of silver nitrate and the aqueous solution of sodium chloride), and then the mixture was kept at 52° C. for 10 minutes.

Emulsion No. 306 was prepared in the same manner as Emulsion 105, except that the time adding the blue-sensitizing dye was varied to the time immediately after the completion of the formation of the silver halide grains (precisely, 1 minute after the second addition of the aqueous solution of silver nitrate and the aqueous solution of sodium chloride), and then the mixture was kept at 52° C. for 10 minutes.

Emulsion No. 307 was prepared in the same manner as Emulsion 106, except that the time adding the green-sensitizing dye was varied to the time immediately after the completion of the formation of the silver halide grains (precisely, 1 minute after the second addition of the aqueous solution of silver nitrate and the aqueous solution of sodium chloride), and then the mixture was kept at 52° C. for 10 minutes.

Emulsion No. 308 was prepared in the same manner as Emulsion 302, except that the time adding the blue-sensitizing dye was varied to the time 10 minutes after the addition of the red-sensitizing dye, and then the mixture was kept at 52° C. for 10 minutes.

Emulsion No. 309 was prepared in the same manner as Emulsion 303, except that the time adding the green-sensitizing dye was varied to the time 10 minutes after the addition of the red-sensitizing dye, and then the mixture was kept at 52° C. for 10 minutes.

Emulsion No. 310 was prepared in the same manner as Emulsion 308, except that the time adding the red-sensitizing dye was exchanged to the time adding the blue-sensitizing dye to each other.

Emulsion No. 311 was prepared in the same manner as Emulsion 309, except that the time adding the red-sensitizing dye was exchanged to the time adding the green-sensitizing dye to each other.

The thus obtained emulsions and the emulsions prepared in Example 1 were used as the emulsion for forming the fifth layer described in Example 2 and color photographic material samples of 14 types were prepared in the same manner as in Example 2. Sample numbers and the emulsion numbers used for forming the fifth layer are shown in Table 7 below.

TABLE 7

| Sample No. | Emulsion No. used for forming fifth layer |
|---|---|
| 301 | Emulsion No. 102 |
| 302 | Emulsion No. 111 |
| 303 | Emulsion No. 112 |
| 304 | Emulsion No. 301 |
| 305 | Emulsion No. 302 |
| 306 | Emulsion No. 303 |

TABLE 7-continued

| Sample No. | Emulsion No. used for forming fifth layer |
|---|---|
| 307 | Emulsion No. 304 |
| 308 | Emulsion No. 305 |
| 309 | Emulsion No. 306 |
| 310 | Emulsion No. 307 |
| 311 | Emulsion No. 308 |
| 312 | Emulsion No. 309 |
| 313 | Emulsion No. 310 |
| 314 | Emulsion No. 311 |

The thus obtained samples were subjected to the sensitometry under the following conditions. Firstly, the samples were exposed (250 CMS, 1 second) to an optical wedge through a red filter (SP-3, manufactured by Fuji Photo Film Co., Ltd.) using a spectral sensitometer (FWH type, manufactured by Fuji Photo Film Co., Ltd., the color temperature of a light source: 3200 K).

The exposed samples were processed for color development using the following processing steps and processing solutions to obtain wedge-like cyan images.

For the thus processed samples, the reflection densities of the cyan images were measured to obtain characteristic curves of the cyan colored layer. From these characteristic curves, gradation values were obtained in accordance with the procedures described in Example 1. The results obtained are shown in Table 8 below.

Next, the red filter was replaced by a yellow filter (CC-Y, manufactured by Fuji Photo Film Co. Ltd.) and a magenta filter (CC-M, manufactured by Fuji Photo Film Co., Ltd.), and the density of these filters and exposure illumination were adjusted to the condition that a wedge-like gray image could be obtained. Under this condition, a cyan filter (CC-C180, manufactured by Fuji Photo Film Co., Ltd.) was used in combination with the yellow filter and the magenta filter, and under the condition above, the samples were exposed and processed in the same manner stated above to obtain wedge-like red images.

For the thus processed samples, the densities of the cyan images developed in the high colored area of the red images were measured to obtain characteristic curves, from which gradation values of the cyan images were obtained. Such the cyan images provide shadows to the high colored area of the red images. The results obtained are shown in Table 8 below.

Further, balls of knitting yarn as disclosed in Example 2 were photographed with a photographic film (Fuji Photo Color Super HR100), and the exposed film was processed to obtain a negative film in the same manner as disclosed in Example 2. The negative film was printed on each of the Samples Nos. 301 to 314 and processed in the same manner as in Example 2 to obtain color prints. The thus obtained color prints were evaluated by color purity and shadow reproduction. The results obtained are shown in Table 8 below.

| Processing Steps | Processing Steps: Temperature (°C.) | Time (sec) | Replenisher (*) (ml) | Capacity of Tank (liter) |
|---|---|---|---|---|
| Color Development | 38.5 | 45 | 73 | 20 |
| Bleach-fixation | 35 | 45 | 60** | 20 |
| Rinsing (1) | 35 | 20 | — | 10 |
| Rinsing (2) | 35 | 20 | — | 10 |
| Rinsing (3) | 35 | 20 | 360 | 10 |
| Drying | 80 | 60 | | |

(*) Amount of replenisher is per $m^2$ of sample being processed.
(**) 120 ml per $m^2$ of replenisher was introduced from Rinsing tank (1) in addition to 60 ml.

(Rinsing was effected by three-tank countercurrent system from rinsing tank (3) to rinsing tank (1).)

| | Tank Solution | Replenisher |
|---|---|---|
| Color Developing Solution | | |
| Water | 700 ml | 700 ml |
| Sodium Triisopropyl-naphthalene (β) Sulfonate | 0.1 g | 0.1 g |
| Ethylenediaminetetra-acetic Acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Brightening Agent (WHITEX 4, manufactured by Sumitomo Chemical Co.) | 1.0 g | 3.0 g |
| Sodium Sulfite | 0.1 g | 0.1 g |
| Disodium-N,N-bis(sulfonatoethyl)-hydroxylamine | 10.0 g | 13.0 g |
| N-ethyl-N-(β-methanesulfon-amidoethyl)-3-methyl-4-aminoaniline Sulfate | 5.0 g | 11.5 g |
| Water to make | 1000 ml | 1000 ml |
| pH (25° C.) | 10.0 | 11.0 |
| Bleach-fixing Solution | | |
| Water | 600 ml | 150 ml |
| Ammonium Thiosulfate (700 g/l) | 100 ml | 250 ml |
| Ammonium Sulfite | 40 g | 100 g |
| Ammonium Ethylenediamine-tetraacetato/Iron (III) | 55 g | 135 g |
| Ethylenediaminetetra-acetic Acid | 5 g | 12.5 g |
| Ammonium Bromide | 40 g | 75 g |
| Nitric Acid (67%) | 30 g | 65 g |
| Water to make | 1000 ml | 1000 ml |
| pH (25° C.) (adjusted with acetic acid and aqueous ammonia) | 5.8 | 5.6 |

TABLE 8

| Sample | Gradation of Cyan Image: Red Exposure | Gradation of Cyan Image: Cyan Exposure | Reproduction of Yarn Balls on Print: Yellow Yarn Balls | Reproduction of Yarn Balls on Print: Red Yarn Balls | Remarks |
|---|---|---|---|---|---|
| 301 | 0.34 | unmeasurable | Rank 2 | Rank 2 | Comparison |
| 302 | 0.29 | 0.30 | Rank 1 | Rank 1 | Invention |
| 303 | 0.28 | 0.30 | Rank 2 | Rank 1 | Invention |
| 304 | 0.33 | unmeasurable | Rank 2 | Rank 2 | Comparison |
| 305 | 0.36 | 0.38 | Rank 1 | Rank 1 | Invention |
| 306 | 0.37 | 0.39 | Rank 2 | Rank 1 | Invention |
| 307 | 0.29 | 0.31 | Rank 1 | Rank 1 | Invention |

TABLE 8-continued

| Sample | Gradation of Cyan Image: Red Exposure | Gradation of Cyan Image: Cyan Exposure | Reproduction of Yarn Balls on Print: Yellow Yarn Balls | Reproduction of Yarn Balls on Print: Red Yarn Balls | Remarks |
|---|---|---|---|---|---|
| 308 | 0.29 | 0.30 | Rank 2 | Rank 1 | Invention |
| 309 | 0.42 | 0.62 | Rank 4 | Rank 4 | Comparison |
| 310 | 0.46 | 0.71 | Rank 2 | Rank 4 | Comparison |
| 311 | 0.34 | 0.36 | Rank 1 | Rank 1 | Invention |
| 312 | 0.35 | 0.37 | Rank 2 | Rank 1 | Invention |
| 313 | 0.44 | 0.65 | Rank 4 | Rank 4 | Comparison |
| 314 | 0.47 | 0.74 | Rank 2 | Rank 4 | Comparison |

From the results shown above, it can be said that the photographic materials by using the emulsions of the present invention have appropriate gradation values to the cyan images which are formed at a time of red exposure and also formed as shadows in the high red colored area at a time of cyan color exposure. Thus, in the present invention, reproduction of a pure color in the printed image as well as reproduction of excellent color gradation in the high red colored area can be achieved and prints having high image quality can be obtained.

As is clear from the comparison of Sample Nos. 302, 303, 305, 306, 307, 308, 311, 312, 313 and 314 to each other, the present invention makes possible to delicately control the cyan gradation by setting the addition time of the red-sensitizing dye appropriately with the use of the nitrogen-containing heterocyclic compound. Thus, in the present invention, an appropriate gradation in accordance with the application of the photographic material can be easily selected.

While the invention has been described in detail and with reference to specific embodiments thereof, it will be apparent to one skilled in the art that various changes and modifications can be made therein without departing from the spirit and scope thereof.

What is claimed is:

1. A method of manufacturing a silver halide emulsion which comprises a silver chlorobromide having a silver chloride content of 90 mol% or more or silver chloride and contains substantially no silver iodide, comprising the steps of, (i) adding to a reactor containing a silver halide emulsion a compound capable of spectrally sensitizing the silver halide emulsion in a wavelength range between 590 nm and 720 nm, (ii) then adding a nitrogen-containing heterocyclic compound to the silver halide emulsion, and (iii) then adding to the reactor a compound capable of spectrally sensitizing the silver halide emulsion in a wavelength range between 390 nm and 590 nm, prior to the completion of chemical sensitization of the silver halide emulsion.

2. The method of manufacturing a silver halide emulsion of claim 1, wherein the step (i) is carried out before the reaction of a silver nitrate with an alkali halide.

3. The method of manufacturing a silver halide emulsion of claim 1, wherein the step (i) is carried out during the reaction of a silver nitrate with an alkali halide.

4. The method of manufacturing a silver halide emulsion of claim 1, wherein the step (i) is carried out during physical ripening after the reaction of a silver nitrate with an alkali halide.

5. The method of manufacturing a silver halide emulsion of claim 1, wherein the step (i) is carried out during a desalting.

6. The method of manufacturing a silver halide emulsion of claim 1, wherein the step (i) is carried out prior to initiating the chemical sensitization.

7. The method of manufacturing a silver halide emulsion of claim 1, wherein the step (i) is carried out during the chemical sensitization.

8. The method of manufacturing a silver halide emulsion of claim 1, wherein the step (i) is carried out prior to initiating a desalting.

9. The method of manufacturing a silver halide emulsion of claim 8, wherein the steps (i) and (ii) are carried out prior to initiating the desalting.

10. The method of manufacturing a silver halide emulsion of claim 1, wherein the emulsion is spectrally sensitized with a cyanine dye of the following general formula (I):

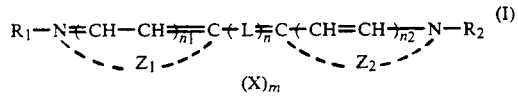

(I)

where

L represents a methine group or a substituted methine group;

R1 and R2 each represent an alkyl group or a substituted alkyl group;

Z1 and Z2 each represent an atomic group for forming a nitrogen-containing 5-membered or 6-membered heterocyclic nucleus;

X represents an anion;

n represents a number of 1, 3 or 5;

n1 and n2 each represents 0 or 1, and when n=5, both n1 and n2 are 0, and when n=3, either n1 or n2 is 0;

m represents 0 or 1, but when the formula forms an internal salt, m is 0; and when n=5, the plurality of L groups may be bonded to each other to form a substituted or unsubstituted 5-membered or 6-membered ring.

11. The method of manufacturing a silver halide emulsion of claim 1, wherein the nitrogen-containing heterocyclic compound is one selected from the group consisting of nucleic acids and decomposed products thereof.

12. The method of manufacturing a silver halide emulsion of claim 1, wherein the nitrogen-containing heterocyclic compound is an azaindene compound of the following general formula (IIa):

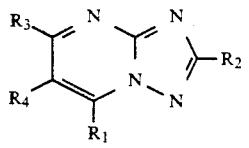

(IIa)

wherein R1, R2, R3 and R4 may be same or different and each represents a hydroxyl group, an alkyl group, an alkenyl group, an aryl group, a cyano group, an ureido group, an amino group, a halogen atom, or a hydrogen atom, provided that the formula contains one or two hydroxyl groups; and R3 and R4 may be bonded to each other to form a 5-membered or 6-memberd saturated or unsaturated ring.

13. The method of manufacturing a silver halide emulsion of claim 1, wherein the nitrogen-containing heterocyclic compound is an azaindene compound of the following general formula (IIb):

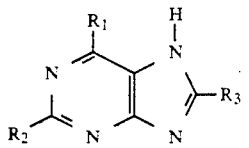

(IIb)

wherein R1, R2 and R3 may be same or different and each represents a hydroxyl group, an alkyl group, an alkenyl group, an aryl group, a cyano group, an ureido group, an amino group, a halogen atom, or a hydrogen atom.

14. The method of manufacturing a silver halide emulsion of claim 1, wherein a mercaptotetrazole compound of the following general formula (IIIa) is added to said emulsion during or after formation of silver halide grains therein or during or after chemical sensitization of the grains or during the coating of the emulsion:

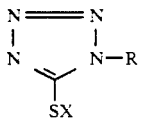

(IIIa)

wherein R represents an alkyl group, an alkenyl group or an aryl group; and X represents a hydrogen atom, an alkali metal atom, an ammonium group, or a precursor thereof.

15. The method of manufacturing a silver halide emulsion of claim 1, wherein a mercaptothiadiazole compound of the following general formula (IVa) is added to said emulsion during or after formation of silver halide grains therein or during or after chemical sensitization of the grains or during the coating of the emulsion:

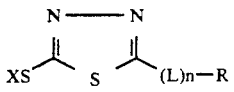

(IVa)

wherein L represents a divalent linking group; R represents a hydrogen atom, an alkyl group, an alkenyl group or an aryl group; and X represents a hydrogen atom, an alkali metal atom, an ammonium group or a precursor thereof.

16. A color photographic material comprising, a support having thereon, at least one light-sensitive emulsion layer containing a yellow coupler capable of forming a yellow dye by coupling with the oxidation product of an aromatic primary amine developing agent, at least one light-sensitive emulsion layer containing a magenta coupler capable of forming a magenta dye by coupling with the oxidation product of an aromatic primary amine developing agent, and at least one light-sensitive emulsion layer containing a cyan coupler capable of forming a cyan dye by coupling with the oxidation product of an aromatic primary amine developing agent, wherein the emulsion layer containing the cyan coupler capable of forming a cyan dye comprises a silver chlorobromide having a silver chloride content of 90 mol% or more or silver chloride and contains substantially no silver iodide, and said emulsion layer containing a cyan coupler has been spectrally sensitized to have a peak of spectral sensitivity distribution both in the wavelength range between 590 nm and 720 nm and in the wavelength range between 390 nm and 590 nm and has been manufactured by the steps of, (i) adding to a reactor containing a silver halide emulsion a compound capable of spectrally sensitizing the silver halide emulsion in a wavelength range between 590 nm and 720 nm, (ii) then adding a nitrogen-containing heterocyclic compound to the silver halide emulsion, and (iii) then adding to the reactor a compound capable of spectrally sensitizing the silver halide emulsion in a wavelength range between 390 nm and 590 nm, prior to the completion of chemical sensitization of the silver halide emulsion.

17. The color photographic material of claim 16, wherein the emulsion layer containing the coupler capable of forming a cyan dye was spectrally sensitized with a cyanine dye of the following general formula (I):

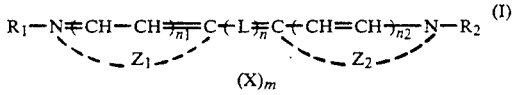

(I)

where

L represents a methine group or a substituted methine group;

R1 and R2 each represent an alkyl group or a substituted alkyl group;

Z1 and Z2 each represent an atomic group for forming a nitrogen-containing 5-membered or 6-membered heterocyclic nucleus;

X represents an anion;

n represents a number of 1, 3 or 5;

n1 and n2 each represents 0 or 1, and when n=5, both n1 and n2 are 0, and when n=3, either n1 or n2 is 0;

m represents 0 or 1, but when the formula forms an internal salt, m is 0; and when n=5, plural L's may be bonded to each other to form a substituted or unsubstituted 5-membered or 6-membered ring.

18. The color photographic material of claim 16, wherein the nitrogen-containing heterocyclic compound is one selected from the group consisting of nucleic acids and decomposed products thereof.

19. The color photographic material of claim 16, wherein the nitrogen-containing heterocyclic compound is an azaindene compound of the general formula (IIa):

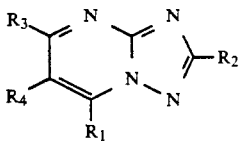

(IIa)

wherein R1, R2, R3 and R4 may be same or different and each represents a hydroxyl group, an alkyl group, an alkenyl group, an aryl group, a cyano group, a ureido group, an amino group, a halogen atom, or a hydrogen atom, provided that the formula contains one or two hydroxyl groups; and R3 and R4 may be bonded to each other to form a 5-membered or 6-memberd saturated or unsaturated ring.

20. The color photographic material of claim 16, wherein the nitrogen-containing heterocyclic compound is an azaindene compound of the general formula (IIb):

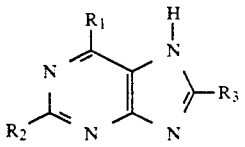

(IIb)

wherein R1, R2 and R3 may be same or different and each represents a hydroxyl group, an alkyl group, an alkenyl group, an aryl group, a cyano group, a ureido group, an amino group, a halogen atom, or a hydrogen atom.

21. The color photographic material of claim 16, wherein a mercaptotetrazole compound of the following general formula (IIIa) is added to said emulsion during or after formation of silver halide grains therein or during or after chemical sensitization of the grains or during the coating of the emulsion:

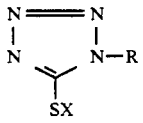

(IIIa)

wherein R represents an alkyl group, an alkenyl group or an aryl group; and X represents a hydrogen atom, an alkali metal atom, an ammonium group, or a precursor thereof.

22. The color photographic material of claim 16, wherein a mercaptothiadiazole compound of the following general formula (IVa) is added .to said emulsion during or after formation of silver halide grains therein or during or after chemical sensitization of the grains or during the coating of the emulsion:

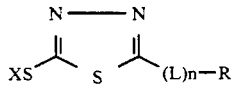

(IVa)

wherein L represents a divalent linking group; R represents a hydrogen atom, an alkyl group, an alkenyl group or an aryl group; and X represents a hydrogen atom, an alkali metal atom, an ammonium group or a precursor thereof.

* * * * *